US010756449B2

(12) United States Patent
Sato et al.

(10) Patent No.: US 10,756,449 B2
(45) Date of Patent: Aug. 25, 2020

(54) CRIMP TERMINAL

(71) Applicant: Yazaki Corporation, Tokyo (JP)

(72) Inventors: Kei Sato, Makinohara (JP); Kazuhide Takahashi, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/420,559

(22) Filed: May 23, 2019

(65) Prior Publication Data

US 2019/0280399 A1 Sep. 12, 2019

Related U.S. Application Data

(63) Continuation of application No. PCT/JP2017/016504, filed on Apr. 26, 2017.

(30) Foreign Application Priority Data

Dec. 27, 2016 (JP) ..... 2016-253772

(51) Int. Cl.
*H01R 4/18* (2006.01)
*H01R 4/62* (2006.01)
(Continued)

(52) U.S. Cl.
CPC ..... *H01R 4/185* (2013.01); *H01R 4/18* (2013.01); *H01R 4/62* (2013.01); *H01R 4/70* (2013.01); *H01R 43/048* (2013.01)

(58) Field of Classification Search
CPC . H01R 4/185; H01R 4/62; H01R 4/70; H01R 43/048
(Continued)

(56) References Cited

U.S. PATENT DOCUMENTS 6,056,605 A * 5/2000 Nguyen ..... H01R 4/188 439/882
8,900,010 B2 * 12/2014 Aoki ..... H01R 4/185 439/587
(Continued)

FOREIGN PATENT DOCUMENTS

CN 102598415 A 7/2012
CN 102859795 A 1/2013
(Continued)

OTHER PUBLICATIONS

International Search Report for PCT/JP2017/016504 dated Aug. 1, 2017 (PCT/ISA/210).

*Primary Examiner* — Alexander Gilman
(74) *Attorney, Agent, or Firm* — Sughrue Mion, PLLC

(57) ABSTRACT

Difficulty of manufacturing is reduced while ensuring waterproof property with respect to a contact portion with an aluminum core wire. A barrel portion of a crimp terminal includes an inner barrel piece and an outer barrel piece, and includes a seal member which is attached over a first region, a second region and a third region and which seals, after crimping, a space between the inner barrel piece and the outer barrel piece, an opening of the barrel portion on a terminal portion side, and a space between a covered portion and the barrel portion. An inner surface of the barrel portion is provided with a plurality of recesses arranged dispersedly, the recess having a circular shape in a plane view with respect to the inner surface.

3 Claims, 35 Drawing Sheets

(51) Int. Cl.
*H01R 4/70* (2006.01)
*H01R 43/048* (2006.01)

(58) Field of Classification Search
USPC ..... 439/866
See application file for complete search history.

(56) References Cited

U.S. PATENT DOCUMENTS

| | | | | |
|---|---|---|---|---|
| 8,905,799 | B2 | 12/2014 | Endo | |
| 8,974,258 | B2 | 3/2015 | Mitose et al. | |
| 9,640,877 | B2 * | 5/2017 | Aoki | H01R 4/62 |
| 10,498,048 | B2 * | 12/2019 | Washio | H01R 43/048 |
| 10,505,287 | B2 * | 12/2019 | Sato | H01R 4/185 |
| 2013/0095708 | A1 * | 4/2013 | Mitose | H01R 4/184 439/878 |
| 2015/0072573 | A1 | 3/2015 | Kawamura et al. | |
| 2015/0140856 | A1 * | 5/2015 | Sato | H01R 4/70 439/523 |
| 2015/0380834 | A1 * | 12/2015 | Seipel | H01R 4/188 439/877 |
| 2016/0233591 | A1 * | 8/2016 | Kondou | H01R 4/188 |
| 2017/0005417 | A1 * | 1/2017 | Aoki | H01R 4/62 |
| 2017/0179619 | A1 * | 6/2017 | Nakata | H01R 4/185 |
| 2017/0179620 | A1 * | 6/2017 | Shinohara | H01R 4/185 |
| 2017/0324172 | A1 * | 11/2017 | Myer | H01R 4/185 |

FOREIGN PATENT DOCUMENTS

| | | | |
|---|---|---|---|
| CN | 104137341 | A | 11/2014 |
| CN | 106170891 | A | 11/2016 |
| JP | 55-108192 | A | 8/1980 |
| JP | 2015-079687 | A | 4/2015 |
| JP | 2015-201269 | A | 11/2015 |
| JP | 5940198 | B2 | 6/2016 |
| WO | 2014/154706 | A1 | 10/2014 |

* cited by examiner

CRIMP TERMINAL

TECHNICAL FIELD

The present invention relates to a crimp terminal configured to be crimp-connected to a covered electric wire having an aluminum core wire.

BACKGROUND ART

In recent years, a covered electric wire having an aluminum core wire has been used for a wire harness in place of a covered electric wire having a copper core wire. Some crimp terminals such as connector terminals, for example, are made of a copper alloy or the like and having a surface that is tin-plated or gold-plated. When the crimp terminal of this type is crimped to an end portion of the covered electric wire where the aluminum core wire is exposed, contact between dissimilar metals occurs between the aluminum core wire and a crimping barrel portion of the crimp terminal. If moisture adheres to such contact portion, the aluminum core wire made of aluminum which is a base metal could be corroded due to so-called dissimilar metal corrosion.

Therefore, there has been proposed a crimp terminal having a seal member arranged to surround the contact portion between the barrel portion and the aluminum core wire (see, for example, Patent Document 1). According to this type of crimp terminal, moisture can be prevented from entering the contact portion of the dissimilar metals, thus generation of dissimilar metal corrosion as described above can be avoided.

FIG. 49 shows an example of a conventional crimp terminal having a seal member arranged to surround a contact portion between a barrel portion and an aluminum core wire.

A crimp terminal 7 shown in FIG. 49 includes a barrel portion 71 and a terminal portion 72 arranged in a predetermined axial direction D71. The barrel portion 71 and the terminal portion 72 are produced from a metal plate made of a copper alloy or the like using sheet-metal processing and have a surface that is subjected to tin plating or gold plating. The barrel portion 71 is a portion that is wound around and crimped to an end portion W7*a* of a covered electric wire W7 having an aluminum core wire W71, where the aluminum core wire W71 is exposed. The terminal portion 72 is a female terminal configured to be connected to a pin terminal, not shown, as an object to be connected.

The barrel portion 71 is configured by bending the metal plate so that a cross section thereof intersecting with the axial direction D71 has a substantially U-like shape. After the end portion W7*a* of the covered electric wire W7 is placed on an inner surface 711 of the barrel portion 71, the barrel portion 71 is wound around and crimped to the end portion W7*a*. A part of the inner surface 711 of the barrel portion 71 serves as a contact portion 711*a* with the aluminum core wire W71 at the end portion W7*a*.

A seal member 73 is provided so as to surround the contact portion 711*a*. When the barrel portion 71 is wound around and crimped to the end portion W7*a*, the seal member 73 seals gaps at the respective portions around the contact portion 711*a* and prevents moisture from entering.

The contact portion 711*a* is provided with a serration 74 having a plurality of grooves arranged in rows in the axial direction D71, each groove extending in an intersecting direction D72 that intersects with the axial direction D71 in a plan view with respect to the contact portion 711*a*. When the barrel portion 71 is wound around and crimped to the end portion W7*a*, edges of the respective grooves of the serration 74 bite into the aluminum core wire W71, thereby obtaining good electrical continuity between the covered electric wire W7 and the crimp terminal 7.

PRIOR ART DOCUMENT

Patent Document

Patent Document 1: JP 5940198 B

SUMMARY OF THE INVENTION

Problem to be Solved by the Invention

However, the above-described conventional crimp terminal as shown as one example in FIG. 49 requires an area of the serration at the inner surface of the barrel portion to be as wide as possible, in order to obtain good electrical continuity between the covered electric wire and the crimp terminal. The seal member is provided so as not to hinder sufficient contact between this serration and the aluminum core wire. Thus, with the area of the serration arranged wide, a space for providing the seal member is arranged narrow, frequently causing difficulty of manufacture.

In addition, in this conventional crimp terminal, pressure applied to the barrel portion during the crimping causes the barrel portion to be elongated. In a case where the inner surface of the barrel portion is provided with the serration including the plurality of grooves arranged in rows, the elongation of the barrel portion is frequently greater in the axial direction orthogonal to the respective grooves. When the barrel portion is elongated, the seal member is also elongated, and thus if the barrel portion is overly elongated, then the seal member becomes partially thin, creating a risk of lowering of waterproof property.

In view of the above-described problem, an object of the present invention is to provide a crimp terminal that can reduce a difficulty of manufacturing while ensuring waterproof property with respect to a contact portion with an aluminum core wire.

Solution to Problem

In order to achieve the above-described object, the present invention provides a crimp terminal including a barrel portion configured to be wound around and crimped to an end portion of a covered electric wire having an aluminum core wire at which the aluminum core wire is exposed, and a terminal portion configured to be connected to a connection object, wherein the barrel portion and the terminal portion are arranged in a predetermined axial direction, wherein the barrel portion includes a bottom plate which extends in the axial direction and on which the end portion of the covered electric wire is to be placed, and an inner barrel piece and an outer barrel piece which extend from the bottom plate on both sides in an intersecting direction intersecting with the axial direction in a plan view with respect to the bottom plate, wherein the barrel portion is configured to be wound around the end portion, during crimping, with the inner barrel piece arranged inside, wherein the crimp terminal includes a seal member configured to be provided over a first region, a second region and a third region, the first region traversing the outer barrel piece in the axial direction, the second region traversing an inner surface of the barrel portion in the intersecting direction at a location closer to the terminal portion than the aluminum core wire, and the third region traversing the inner surface in the intersecting direction so as to intersect with a covered portion of the end portion, wherein the seal member is configured to seal, after the crimping, a space between the inner barrel piece and the outer barrel piece, an opening of the barrel portion formed tubular located on a side of the terminal portion, and a space between the covered portion and the barrel portion, and wherein the inner surface of the barrel portion is provided with a plurality of recesses arranged dispersedly, the recess having a circular shape or an oval shape in a plan view with respect to the inner surface.

According to the crimp terminal of the present invention, edge of each recess provided on the inner surface of the barrel portion bites into the aluminum core wire, thereby providing good electrical continuity between the covered electric wire and the crimp terminal. That is, the plurality of recesses is dispersedly provided, thereby forming a serration on the inner surface of the barrel portion. Degree of electrical continuity at the serration is determined by sum of lengths of portions which bite into the aluminum core wire per unit area. In the crimp terminal of the present invention, this sum of lengths corresponds to sum of perimeters of the recesses formed into a circular shape or oval shape. In contrast, for example, in the serration 74 shown in FIG. 49, it is the sum of lengths of edges of the linearly extending groove, and, considering this sum in terms of per unit area, the sum of perimeters of the plurality of recesses formed into a circular shape or oval shape is greater than the sum of lengths of edges of the linearly extending groove. In other words, according to the crimp terminal of the present invention, an area of the serration required to obtain good electrical continuity between the covered electric wire and the crimp terminal can be reduced compared to, for example, the conventional crimp terminal 7 shown in FIG. 49. By virtue of the reduction in the area of the serration, it is possible to provide a wide space for providing the seal member for ensuring waterproof property with respect to the contact portion with the aluminum core wire, reducing difficulty of manufacturing. That is, according to the crimp terminal of the present invention, difficulty of manufacturing can be reduced while ensuring waterproof property with respect to the contact portion with the aluminum core wire.

Furthermore, the circular or oval recess has a resistance force against a force to expand the recess in an in-plane direction of the inner surface 11*a* of the barrel portion 11 that is stronger compared to, for example, a groove constituting the serration 74 shown in FIG. 49. Pressure applied to the barrel portion during the crimping is force acting in the in-plane direction of the inner surface of the barrel portion, and in the crimp terminal of the present invention, the resistance force at each recess against such pressure is strong. Consequently, according to the crimp terminal of the present invention, the elongation of the barrel portion due to the pressure applied during the crimping can be inhibited. As a result, elongation of the seal member can also be inhibited, thereby ensuring waterproof property at a high level. In this sense also, the crimp terminal of the present invention can reduce difficulty of manufacturing while ensuring waterproof property at a high level.

It is preferable that in the crimp terminal of the present invention, a groove is formed on the inner surface of the barrel portion in the first region, the second region and the third region so as to overlap with the seal member, and wherein the plurality of recesses is provided so as to avoid the groove.

According to this crimp terminal in the preferable form, movement of the seal member due to the pressure applied during the crimping can be inhibited by the groove overlapping with the seal member. Therefore, the crimp terminal of this crimp terminal in the preferable form can reduce difficulty of manufacturing while ensuring waterproof property at a higher level.

Advantageous Effect of the Invention

According to the present invention, the crimp terminal that can reduce a difficulty of manufacturing while ensuring waterproof property with respect to the contact portion with the aluminum core wire, can be provided.

DESCRIPTION OF EMBODIMENTS

In the following, an embodiment of the present invention will be explained variously. Firstly, a first embodiment will be explained along with modified examples thereof.

Figure 1:
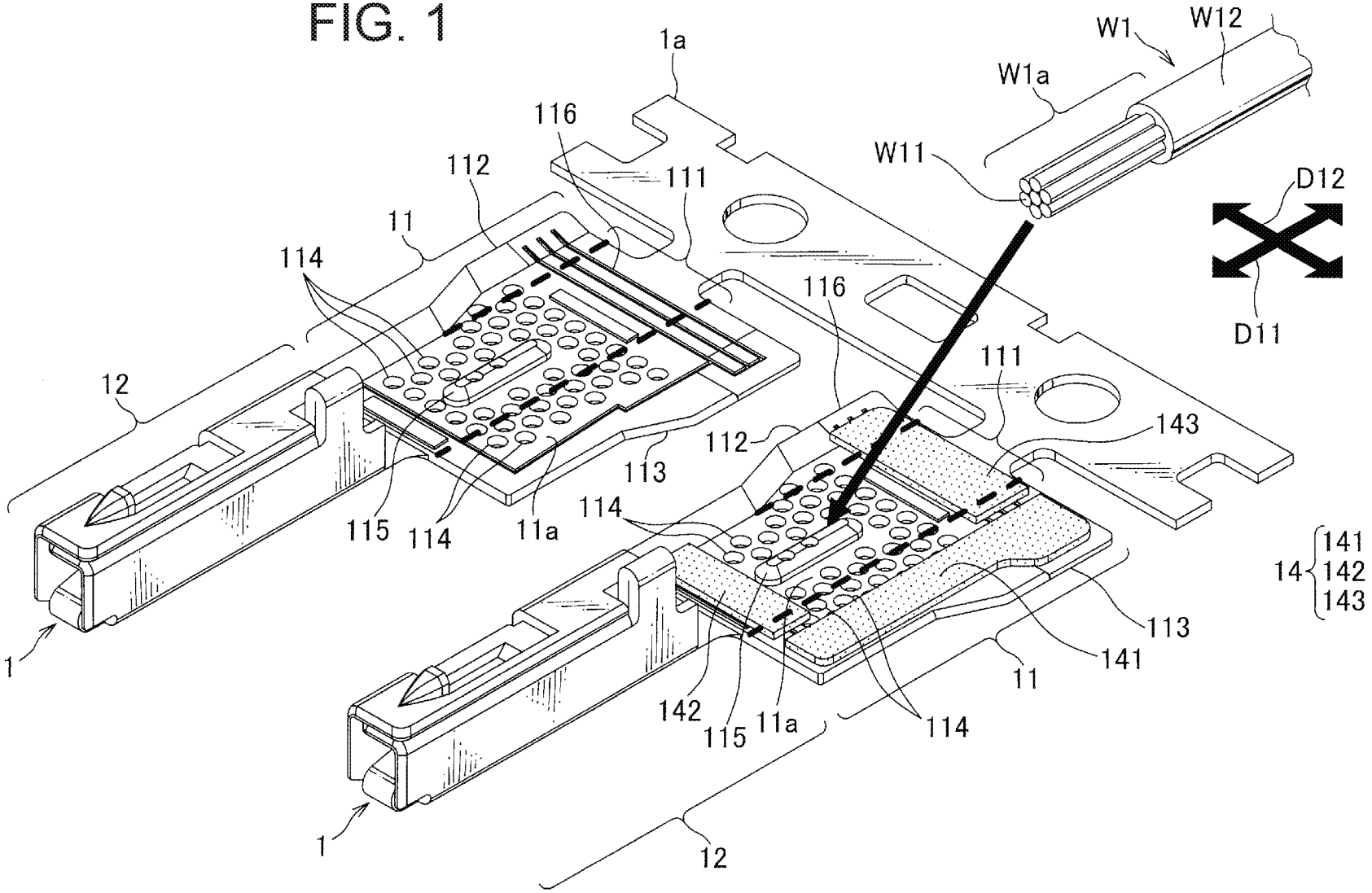
FIG. 1 illustrates a crimp terminal according to a first embodiment of the present invention.

FIG. 1 illustrates a crimp terminal according to the first embodiment of the present invention.

A crimp terminal 1 according to this embodiment is configured to be crimped to an end portion W1*a* of a covered electric wire W1 having an aluminum core wire W11, at which the aluminum core wire W11 is exposed. The crimp terminal 1 includes a barrel portion 11, a terminal portion 12 and a seal member 14. In FIG. 1, two crimp terminals 1 are shown, of which one crimp terminal 1 is shown with the seal member 14 removed for the purpose of providing a view of shape of an inner surface of the barrel portion 11.

The barrel portion 11 and the terminal portion 12 are produced from a metal plate made of a copper alloy or the like using punching and sheet-metal processing, and a surface thereof is tin-plated or gold-plated. The barrel portion 11 and the terminal portion 12 are arranged in a predetermined axial direction D11. In this embodiment, the barrel portions 11 and the terminal portions 12 are collectively formed in a state that a plurality of crimp terminals 1 is connected to each other by a strip-like connecting piece 1*a*. The barrel portion 11 is a plate-like portion that is to be wound around and crimped to the end portion W1*a* of the covered electric wire W1 so as to circumferentially wrap the aluminum core wire W11 and a covered portion W12. The terminal portion 12 is a quadrangular tube-shaped female terminal configured to be connected to a pin terminal, not shown, as an object to be connected.

The barrel portion 11 includes a bottom plate 111, an inner barrel piece 112 and an outer barrel piece 113. The bottom plate 111 is a portion extending in the above-described axial direction D11. The inner barrel piece 112 and the outer barrel piece 113 are portions extending from the bottom plate 111 on both sides in an intersecting direction D12 intersecting the axial direction D11 in a plan view with respect to the bottom plate 111. When being crimped to the end portion W1*a* of the covered electric wire W1, the barrel portion 11 is wound around the end portion W1*a* such that the inner barrel piece 112 is arranged inside and the outer barrel piece 113 is arranged outside, as described later.

A plurality of recesses 114 is dispersedly provided on an inner surface 11*a* of the barrel portion 11. Each recess 114 is formed into a circular shape in a plan view with respect to the inner surface 11*a* of the barrel portion 11. Furthermore, a protrusion 115 is formed on the bottom plate 111 of the barrel portion 11 at a location where the aluminum core wire W11 at the end portion W1*a* of the covered electric wire W1 is to be placed, and is formed by pressing applied from an outer surface side. Some of the plurality of recesses 114 are also formed on this protrusion 115.

A seal member 14 formed of an adhesive gel sheet is attached to the inner surface 11*a* of the barrel portion 11 so as to surround the plurality of recesses 114 from three sides in a plan view. The seal member 14 is attached as described below. Herein, examples of the adhesive gel sheet may include, but not limited to, those using acrylic adhesives.

Figure 2:
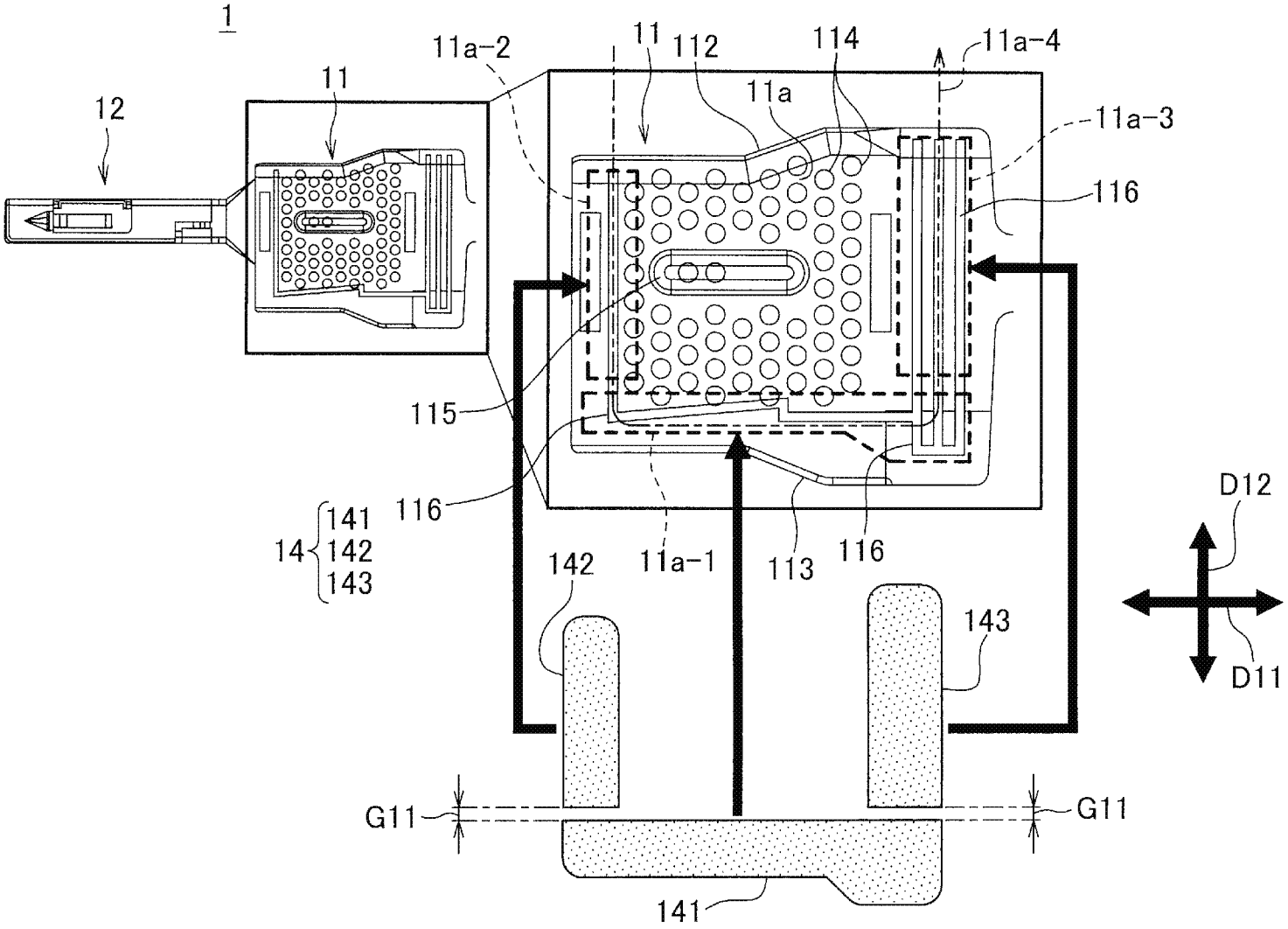
FIG. 2 illustrates how a seal member shown in FIG. 1 is attached to an inner surface of a barrel portion.

FIG. 2 illustrates how the seal member shown in FIG. 1 is attached to the inner surface of the barrel portion.

The seal member 14 is formed of an adhesive gel sheet and is arranged over three regions on the inner surface 11*a* of the barrel portion 11, namely a first region 11*a*-1, a second region 11*a*-2 and a third region 11*a*-3. The first region 11*a*-1 is a region that traverses the outer barrel piece 113 in the axial direction D11. The second region 11*a*-2 is a region that traverses the inner surface 11*a* in the intersecting direction D12 on a side closer to the terminal portion 12 than the aluminum core wire W11 when the end portion W1*a* is placed. The third region 11*a*-3 is a region that traverses the inner surface 11*a* in the intersecting direction D12 so as to intersect with the covered portion W12 of the end portion W1*a*.

As shown in FIGS. 1 and 2, in this embodiment, the seal member 14 is composed of three portions, namely, a first seal portion 141, a second seal portion 142 and a third seal portion 143. The first seal portion 141 is a portion extending in a strip-like shape in the axial direction D11 in the first region 11*a*-1. The second seal portion 142 is a portion extending in a strip-like shape in the intersecting direction D12 in the second region 11*a*-2. The third seal portion 143 is a portion extending in a strip-like shape in the intersecting direction D12 in the third region 11*a*-3.

In this embodiment, the seal member 14 is attached in a divided manner that the seal member 14 is divided in the partway of a path 11*a*-4 extending from the second region 11*a*-2 through the first region 11*a*-1 to the third region 11*a*-3. Specifically, the seal member 14 is attached in a manner that both of the second seal portion 142 and the third seal portion 143 are divided from the first seal portion 141. Further, each of the second seal portion 142 and the third seal portion 143 is attached while being divided from the first seal portion 141 in a manner traversing the path 11*a*-4 in the axial direction D11. Slight gaps G11 are formed between the second seal portion 142 and the first seal portion 141, and between the third seal portion 143 and the first seal portion 141.

In this embodiment, on the inner surface 11*a* of the barrel portion 11, a groove 116 is formed in the first region 11*a*-1, the second region 11*a*-2 and the third region 11*a*-3, so as to overlap with the seal member 14. In the first region 11*a*-1, one groove 116 extends in the axial direction D11 while bending in a sawtooth shape in the partway. In the second region 11*a*-2, one groove 116 extends linearly in the intersecting direction D12, and in the third region 11*a*-3, three grooves 116 extend linearly in the intersecting direction D12 and are joined on a side of the first region 11*a*-1. The plurality of recesses 114 is provided so as to avoid the grooves 116.

The first seal portion 141, the second seal portion 142 and the third seal portion 143 are attached so as to overlap the grooves 116 of the first region 11*a*-1, the second region 11*a*-2 and the third region 11*a*-3, respectively. The plurality of recesses 114 is provided such that a part thereof overlaps with the seal member 14. Specifically, as shown in FIG. 2, the recesses 114 located closest to an edge of the outer barrel piece 113 partially overlap with the first region 11*a*-1, and the recesses 114 located closest to the terminal portion 12 partially overlap with the second region 11*a*-2. As a result, the part of the recesses 114 will partially overlap with the first seal portion 141 that is attached to the first region 11*a*-1 and with the second seal portion 142 that is attached to the second region 11*a*-2.

The crimp terminal 1 described above is manufactured using a terminal manufacturing method as described below.

In this terminal manufacturing method, firstly, a sheet-metal processing step for forming a structural object prior to the attachment of the seal member 14 is performed. In the sheet-metal processing step, the barrel portion 11 is formed together with the terminal portion 12 from the metal plate. As described above, in this embodiment, in this sheet-metal processing step, the barrel portion 11 and the terminal portion 12 are collectively formed with the plurality of crimp terminals 1 connected together by the strip-like connecting piece 1*a*. In this sheet-metal processing step, the formation of the plurality of recesses 114, the formation of the protrusion 115 and the formation of the grooves 116 on the inner surface 11*a* of the barrel portion 11 are also performed.

Subsequently, the seal member attaching step is performed in which the seal member 14 is formed from an adhesive gel sheet, and the seal member 14 is attached over the first region 11*a*-1, the second region 11*a*-2 and the third region 11*a*-3. This seal member attaching step is a step for attaching the seal member 14 in a manner that the seal member 14 is divided in the partway of the path 11*a*-4 extending from the second region 11*a*-2 through the first region 11*a*-1 to the third region 11*a*-3. In other words, the first seal portion 141, the second seal portion 142 and the third seal portion 143 are individually attached to the inner surface 11*a* of the barrel portion 11.

Further, in the seal member attaching step, the first seal portion 141, the second seal portion 142 and the third seal portion 143 are punched out from the adhesive gel sheet and attached to the inner surface 11*a* of the barrel portion 11. By pushing the adhesive gel sheet toward each of the attachment locations on the inner surface 11*a* of the barrel portion 11 while punching out the adhesive gel sheet with a cutter for punching out each seal portion, the punching out and the attaching are performed at approximately the same time.

The crimp terminal 1 manufactured as described above is crimped to the end portion W1*a* of the covered electric wire W1 as follows.

Figure 3:
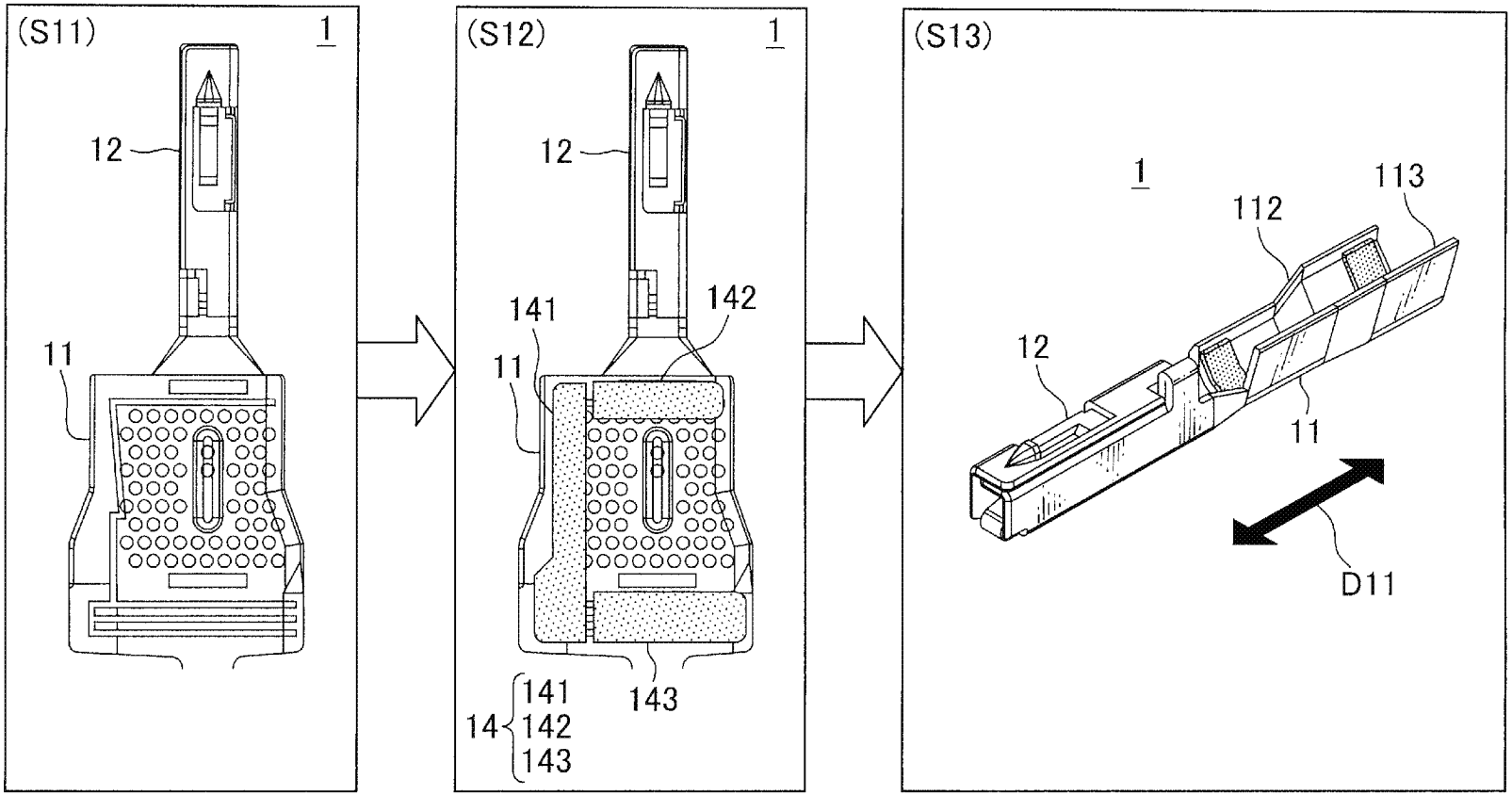
FIG. 3 illustrates a procedure of completing preparation of the crimp terminal shown in FIGS. 1 and 2 that is ready to be crimped to an end portion of a covered electric wire.
Figure 4:
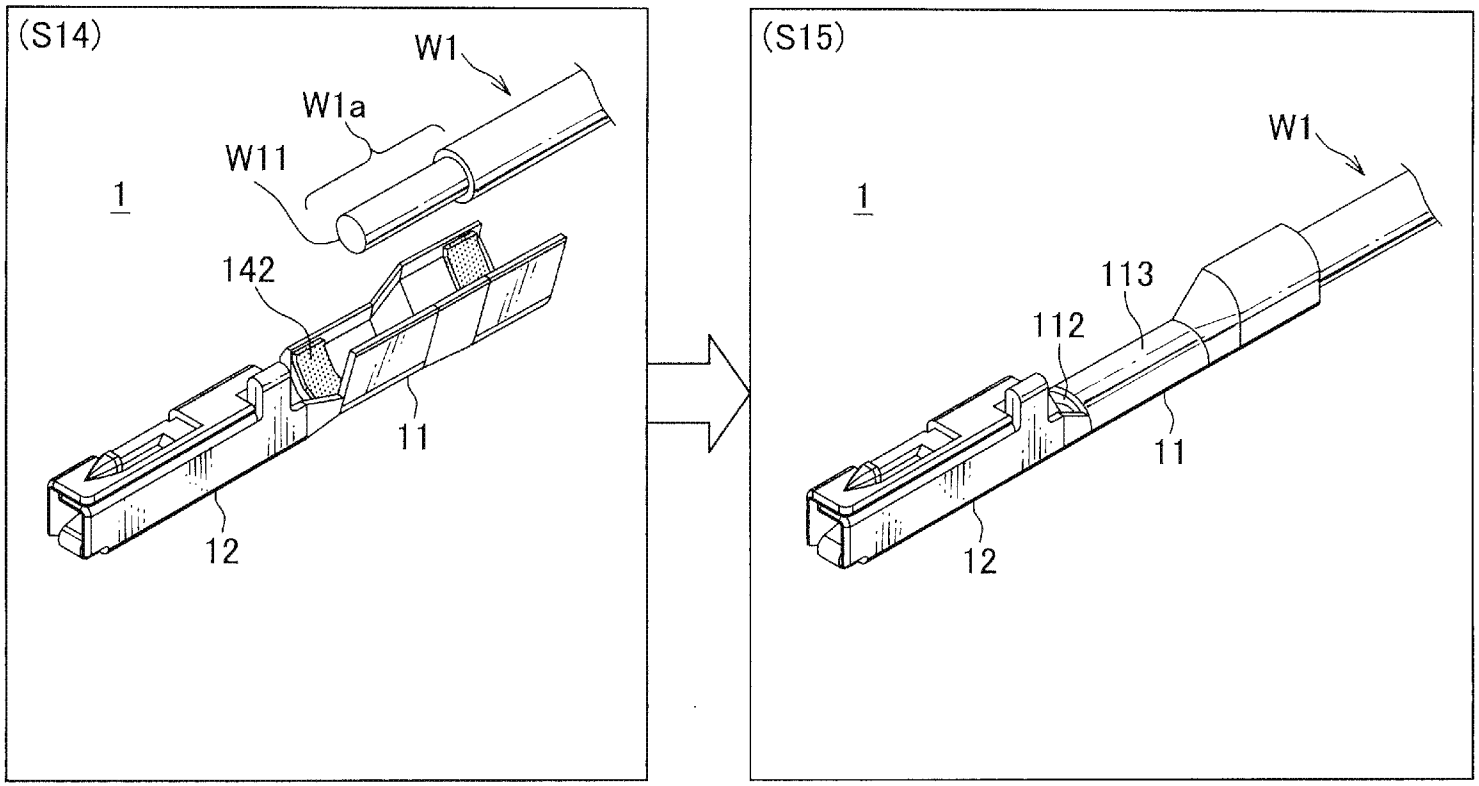
FIG. 4 illustrates a procedure, that follows the procedure shown in FIG. 3, of crimping the crimp terminal to the end portion of the covered electric wire.

FIG. 3 illustrates a procedure for completing preparation of the crimp terminal shown in FIGS. 1 and 2 that is ready to be crimped to the end portion of the covered electric wire using the terminal connecting method, and FIG. 4 illustrates a procedure, that follows the procedure shown in FIG. 3, for crimping the crimp terminal to the end portion of the covered electric wire.

FIG. 3 also shows the sheet-metal processing step (S11) and the seal member attaching step (S12) in the terminal manufacturing method described above. The barrel portion 11 and the terminal portion 12 are formed in the sheet-metal processing step (S11), and the first seal portion 141, the second seal portion 142 and the third seal portion 143 constituting the seal member 14 are attached in the seal member attaching step (S12).

When crimping to the end portion W1*a* of the covered electric wire W1, firstly, the crimp terminal 1 to be crimped is detached from the connecting piece 1*a* shown in FIG. 1. Then, this barrel portion 11 is subjected to a bending deformation as preparation for placing the end portion W1*a* of the covered electric wire W1 (S13). This bending deformation is performed such that the inner barrel piece 112 and the outer barrel piece 113 are brought close to each other so that the cross section intersecting with the axial direction D11 is formed into a substantially U-like shape.

Subsequently, the end portion W1*a* of the covered electric wire W1 is placed onto the barrel portion 11 after being subjected to the bending deformation (S14). At this time, the end portion W1*a* is placed such that a tip of the aluminum core wire W11 does not overlap with the second seal portion 142. However, a small overlap between the tip of the aluminum core wire W11 and the second seal portion 142 is allowed. Subsequently, the barrel portion 11 is wound around and crimped to the end portion W1*a* such that the inner barrel piece 112 is arranged inside and the outer barrel piece 113 is placed onto the inner barrel piece 112 (S15).

As a result of such crimping, the seal member 14 seals the respective portions of the crimp terminal 1 as follows.

Figure 5:
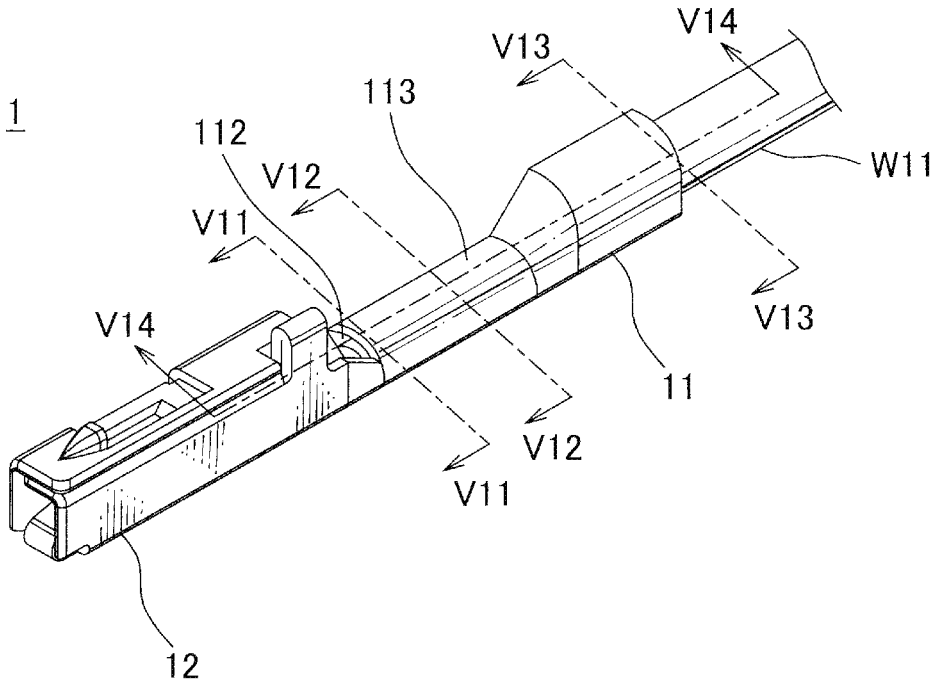
FIG. 5 illustrates the crimp terminal after the crimping that is also shown in FIG. 4.
Figure 6:
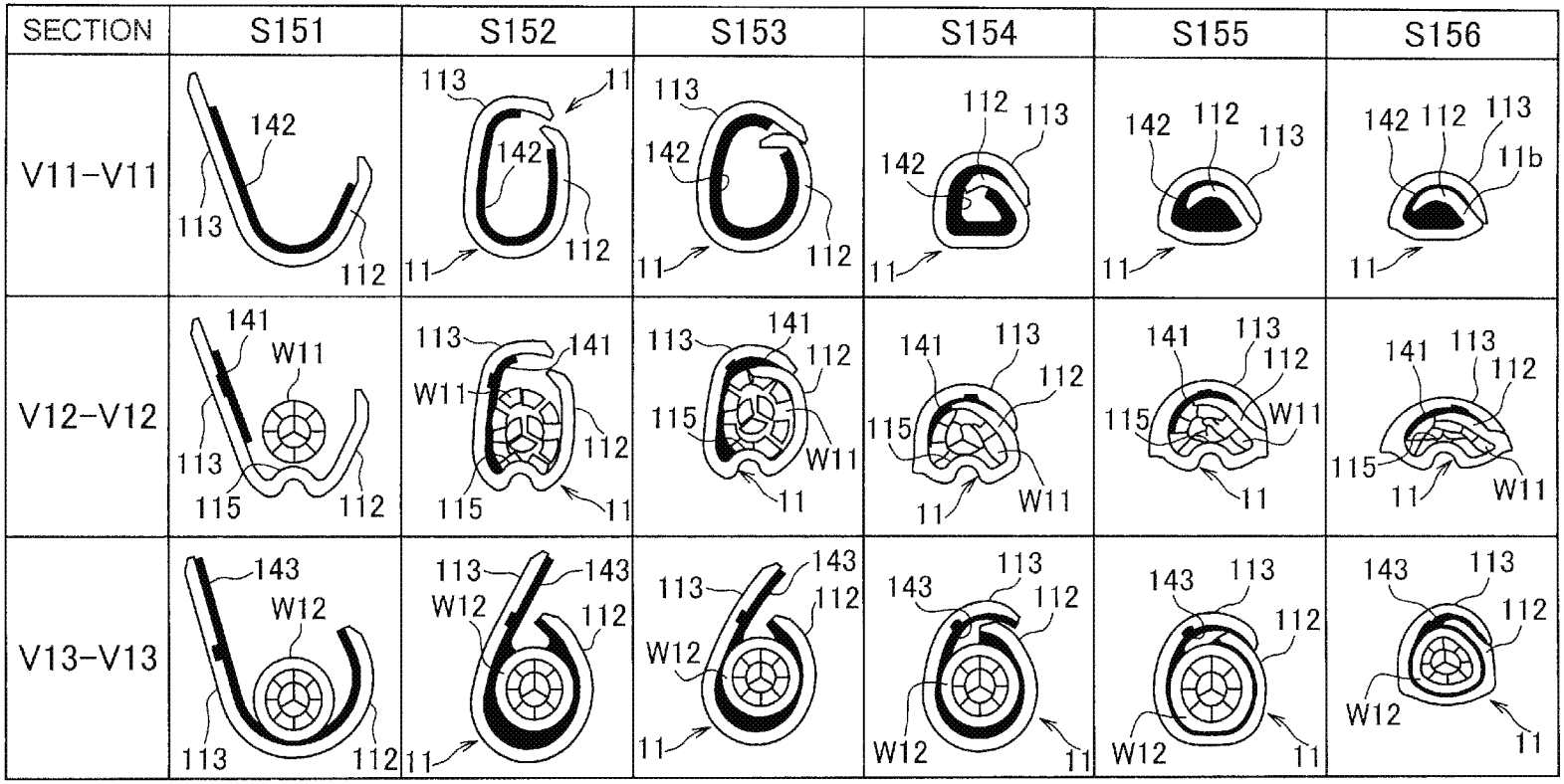
FIG. 6 shows changes during a crimping operation in a cross section taken along line V11-V11, a cross section taken along line V12-V12, and a cross section taken along line V13-V13 in FIG. 5.

FIG. 5 shows the crimp terminal after the crimping that is also shown in FIG. 4. FIG. 6 shows changes during the crimping operation in a cross section taken along line V11-V11, a cross section taken along line V12-V12, and a cross section taken along line V13-V13 in FIG. 5.

In a first step (S151) of the crimping operation, bending of the inner barrel piece 112 and the outer barrel piece 113 is started such that the inner barrel piece 112 and the outer barrel piece 113 are wound around the aluminum core wire W11 on the protrusion 115 and around the covered portion W12 in the vicinity thereof. At this time, the positional relationship is such that, the first seal portion 141 is in contact with the aluminum core wire W11, the third seal portion 143 is in contact with the covered portion W12, and large part of the second seal portion 142 is substantially not in contact with any of the aluminum core wire W11 and the covered portion W12. In a second step (S152) and a third step (S153) where the winding is slightly advanced, the barrel portion 11 is formed into a tubular shape. Then, the first seal portion 141 is sandwiched between the inner barrel piece 112 and the outer barrel piece 113, and the third seal portion 143 is elongated while being sandwiched between the covered portion W12 and the barrel portion 11.

In a fourth step (S154), a fifth step (S155) and a sixth step (S156) where pressure is applied to the aluminum core wire W11 and such, edges of the plurality of recesses 114 bite into the aluminum core wire W11. Also, at that time, strands of the aluminum core wire W11 are separated and spread by the protrusion 115 located underneath the aluminum core wire W11, thus the number of strands contacting the barrel portion 11 is increased. The elongation of the seal member 14 progresses simultaneously.

Here, as described above, in this embodiment, the slight gaps G11 are formed between the second seal portion 142 and the first seal portion 141, and between the third seal portion 143 and the first seal portion 141. These gaps G11 are closed by the above-described elongation of the seal member 14 during the crimping.

Figure 7:
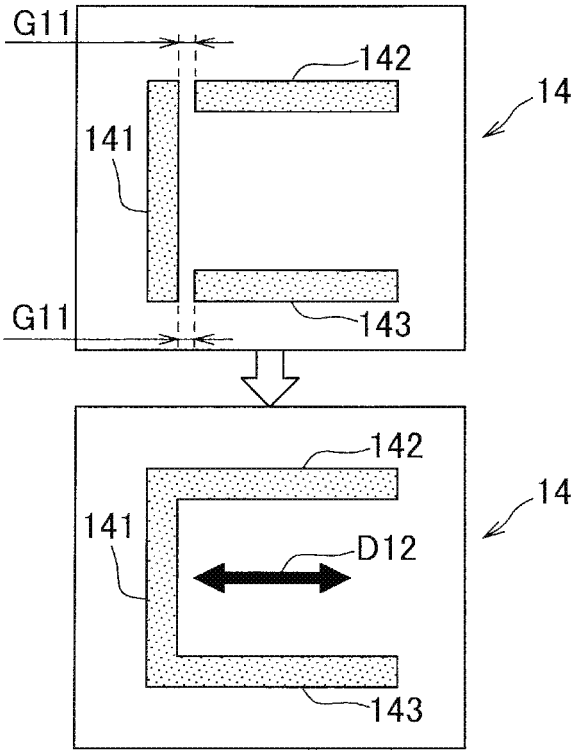
FIG. 7 is a schematic diagram showing how a gap between a second seal portion and a first seal portion and a gap between a third seal portion and the first seal portion shown in FIG. 2 are closed by elongation of the seal member during the crimping.

FIG. 7 is a schematic view showing how the gaps between the second seal portion and the first seal portion and between the third seal portion and the first seal portion shown in FIG. 2 are closed by the elongation of the seal member during the crimping.

As shown in FIG. 7, during the crimping, the second seal portion 142 and the third seal portion 143 are elongated in the intersecting direction D12 which coincides with a length direction thereof. Due to this elongation, the second seal portion 142 and the third seal portion 143 are connected to the first seal portion 141, thereby closing the above-described gaps G11.

Next, in the sixth step (S156), a space between the inner barrel piece 112 and the outer barrel piece 113, an opening 11*b* of the tubular barrel portion 11 on a side of the terminal portion 12, and a space between the covered portion W12 and the barrel portion 11 are sealed by the elongated seal member 14.

Figure 8:
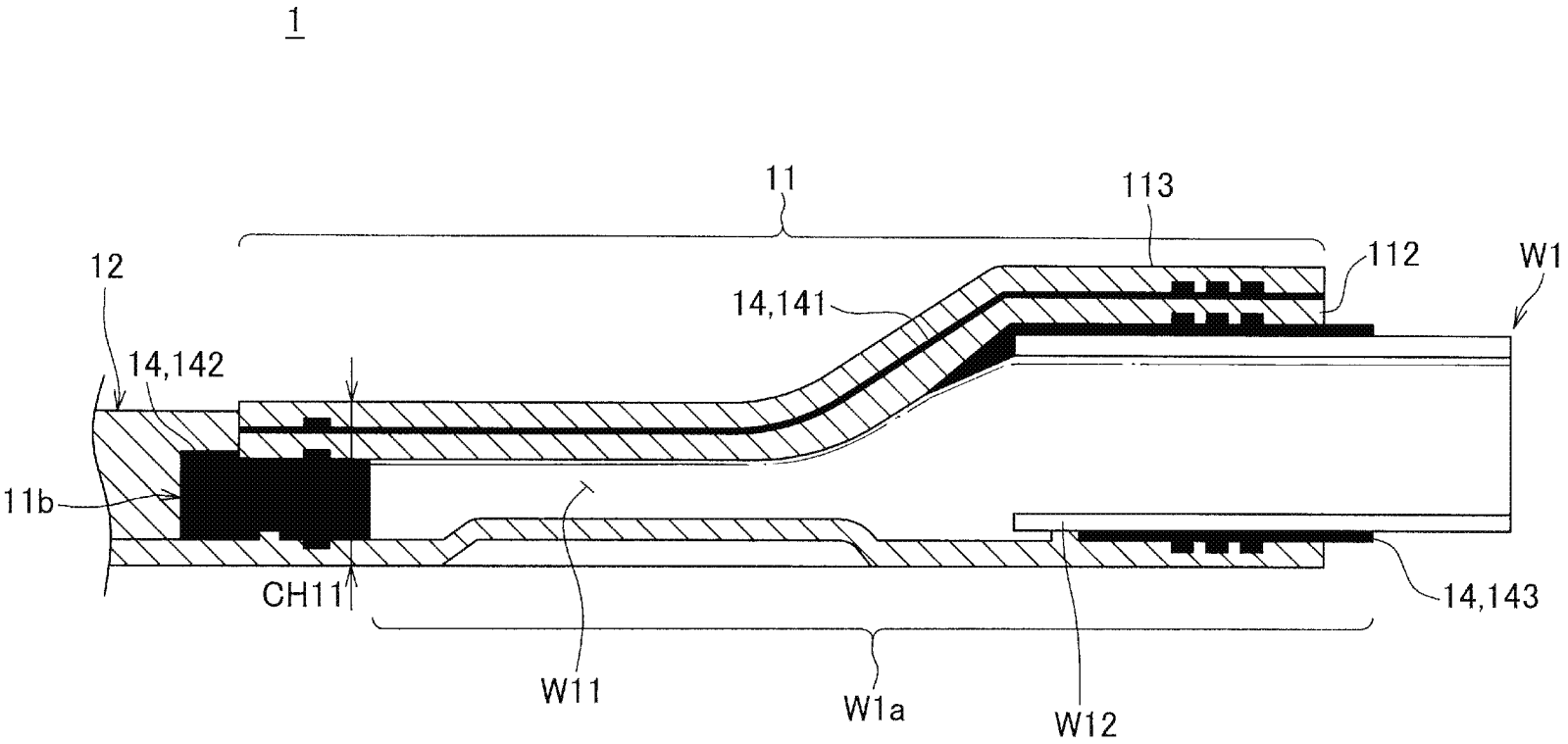
FIG. 8 is a cross sectional view taken along line V14-V14 in FIG. 5 and illustrates how the seal member seals respective portions of the barrel portion of the crimp terminal after the crimping.

FIG. 8 is a cross sectional view taken along line V14-V14 in FIG. 5 and illustrates how the seal member seals the respective portions of the barrel portion of the crimp terminal after the crimping. As shown in FIG. 8, the space between the inner barrel piece 112 and the outer barrel piece 113 is sealed by the first seal portion 141, and the opening 11*b* of the barrel part 11 on the side of the terminal portion 12 is sealed by the second seal portion 142. Furthermore, the space between the covered portion W12 and the barrel portion 11 is sealed by the third seal portion 143.

In this embodiment, a dimension of the barrel portion 11 after the crimping (hereinafter called, "crimp height CH11") in an up-down direction in FIG. 8 in which pressure is mainly applied, is set to be the following dimension. That is, the dimension is set such that the tubular barrel portion 11 is crushed to an extent that a part of the seal member 14 formed of an adhesive gel sheet having a certain thickness and width projects from the opening 11*b* of the barrel portion 11. By setting the crimp height CH11 to this dimension, the opening 11*b* of the barrel portion 11 will be sealed at a high level. Furthermore, also at the side of the barrel portion 11 at which the covered electric wire W1 is extending out, a part of the seal member 14 projects out from between the covered portion W12 and the barrel portion 11, thereby sealing this portion at a high level. In other words, the dimension such as a width of each of the first seal portion 141, the second seal portion 142 and the third seal portion 143 constituting the seal member 14 is set to a dimension necessary and sufficient to achieve the above-described sealing after the crimping.

Furthermore, by forming each portion of the seal member 14 so as to project from the opening 11*b* of the barrel portion 11 and from the side of the barrel portion 11 at which the covered electric wire W1 extends out, it is possible to visually check that these portions are securely sealed with the seal member 14 after the crimping.

Figure 9:
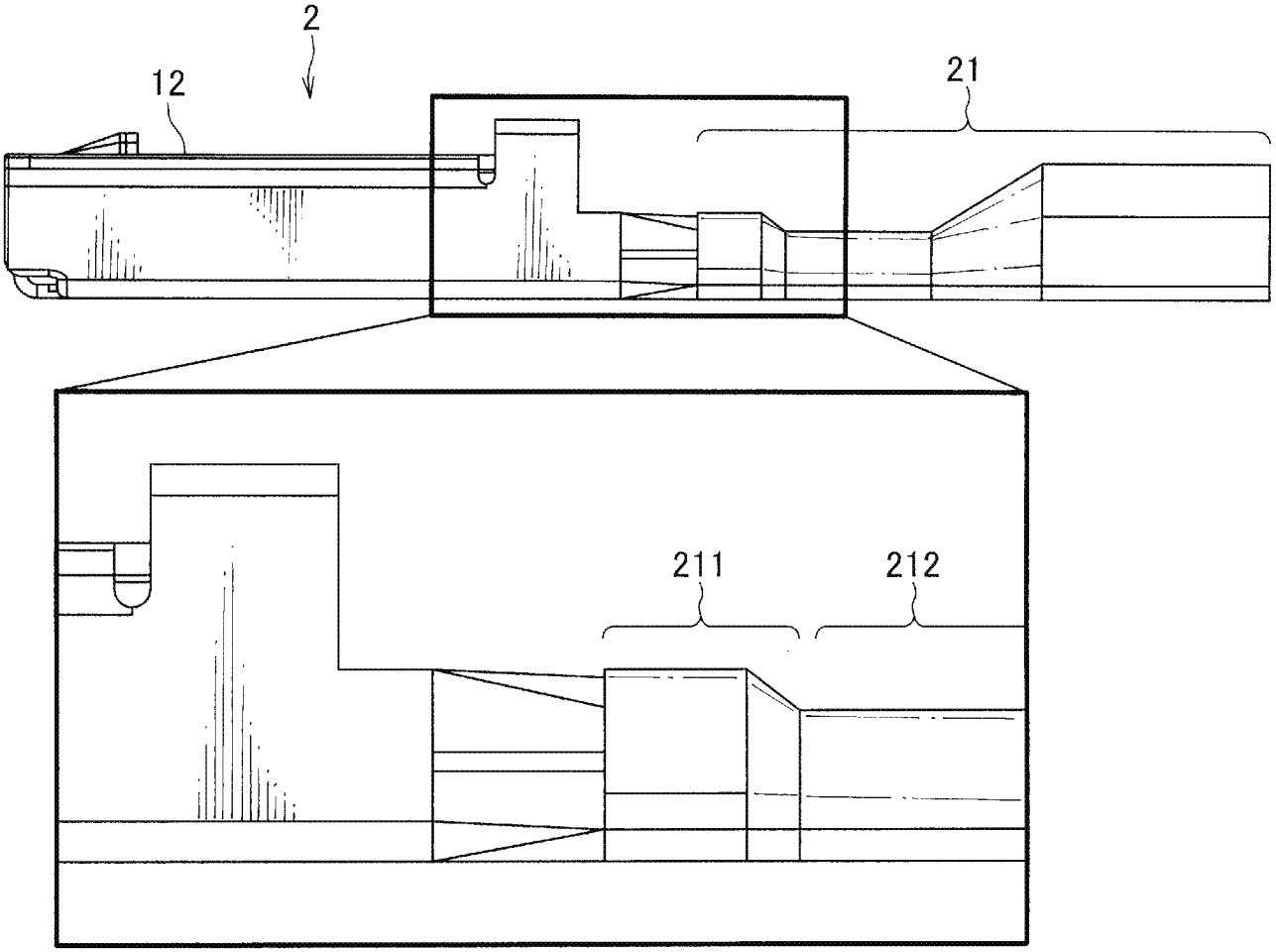
FIG. 9 shows a crimp terminal of a first modified example with respect to the crimp terminal of the first embodiment shown in FIGS. 1-8.
Figure 10:
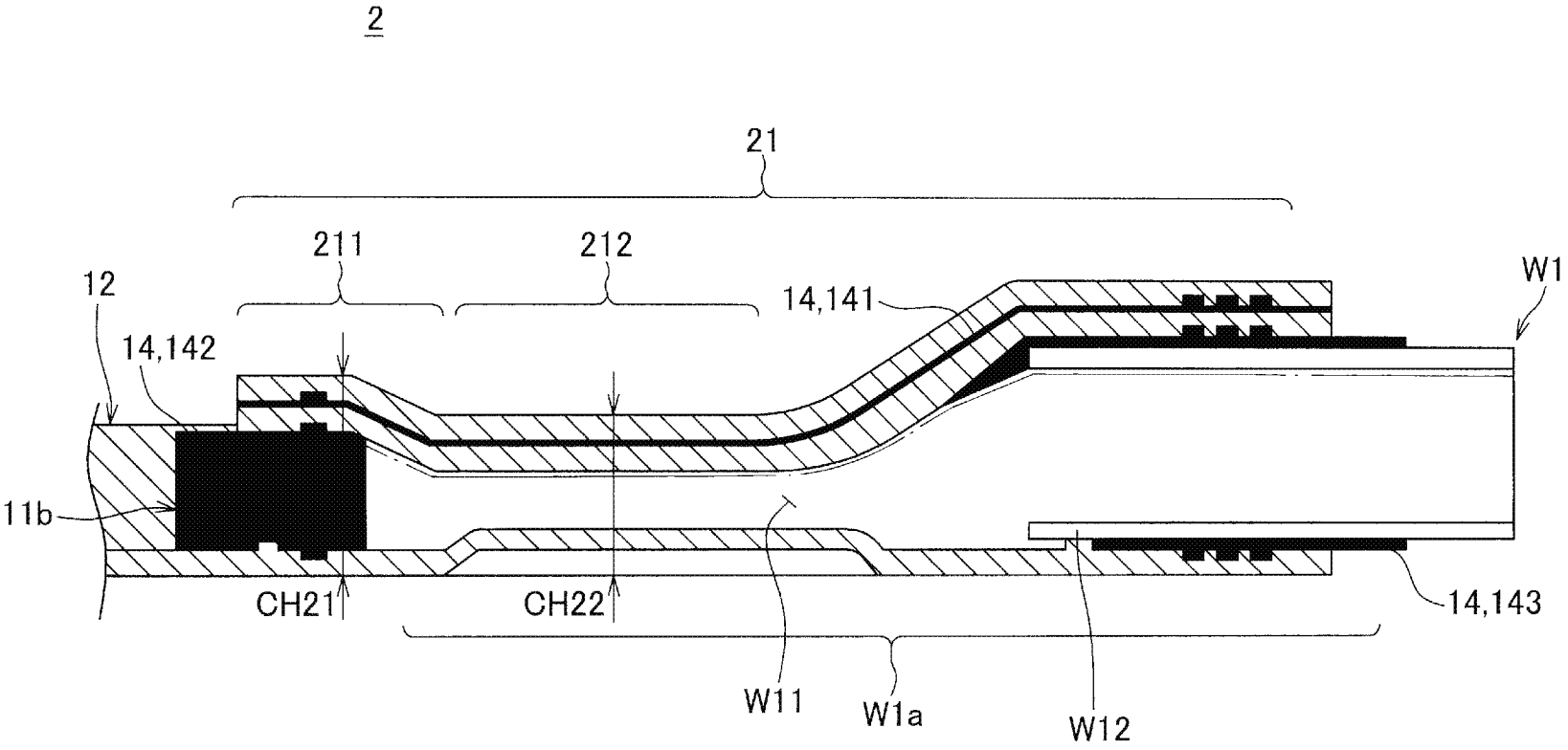
FIG. 10 shows a cross-sectional view, that is similar to FIG. 8, of the crimp terminal of the first modified example.

FIG. 9 shows a crimp terminal of a first modified example with respect to the crimp terminal of the first embodiment shown in FIGS. 1-8. FIG. 10 shows a cross-sectional view, that is similar to FIG. 8, of the crimp terminal of the first modified example shown in FIG. 9. In FIGS. 9 and 10, elements similar to those shown in FIGS. 1-8 are denoted by the same reference signs as FIGS. 1-8, and explanation of these similar elements is omitted in the following description.

A crimp terminal 2 of this first modified example is crimped such that a crimp height CH21 at the terminal portion 12 side of a barrel portion 21 (hereinafter called, "front end portion 211") after the crimping is greater than a crimp height CH22 of a crimp portion 212 of the aluminum core wire W11. In this case also, the crimp height CH21 of the front end portion 211 has a dimension that allows a part of the seal member 14 to project from the opening 11*b* of the barrel portion 11 and seal at a high level. The dimension such as a width of each of the first seal portion 141, the second seal portion 142 and the third seal portion 143 constituting the seal member 14 is set to a dimension necessary and sufficient to achieve the above-described sealing after the crimping. By making the crimp height CH22 of the crimp portion 212 to be relatively small as described above, the bonding of the aluminum core wire W11 is enhanced, thereby improving reliability of contact with the crimp terminal 2.

In the crimp terminal 1 of this embodiment described above, the crimping causes the edges of the respective recesses 114 provided on the inner surface 11*a* of the barrel portion 11 to bite into the aluminum core wire W1*a*, thereby providing good electrical continuity between the covered electric wire W1 and the crimp terminal 1. Furthermore, the seal member 14 formed of an adhesive gel sheet is attached to the inner surface 11*a* of the barrel portion 11. This seal member 14 seals, after the crimping, the space between the inner barrel piece 112 and the outer barrel piece 113, the opening 11*b* of the barrel portion 11, that is formed into a tubular shape, on the side of the terminal portion 12, and the space between the covered portion W12 and the barrel portion 11. This seal member 14 ensures waterproof property with respect to a contact portion at which a dissimilar metal contact occurs between the aluminum core wire W1*a* and the inner surface 11*a* of the barrel portion 11. Further, in this embodiment, the seal member 14 is attached in a divided manner that it is divided in the partway of a path 11*a*-4 extending from the second region 11*a*-2 through the first region 11*a*-1 to the third region 11*a*-3. That is, the seal member 14, which has a complicated shape to follow the above-described path 11*a*-4 in order to obtain waterproof property, is divided into individual pieces and attached piece by piece.

Figure 11:
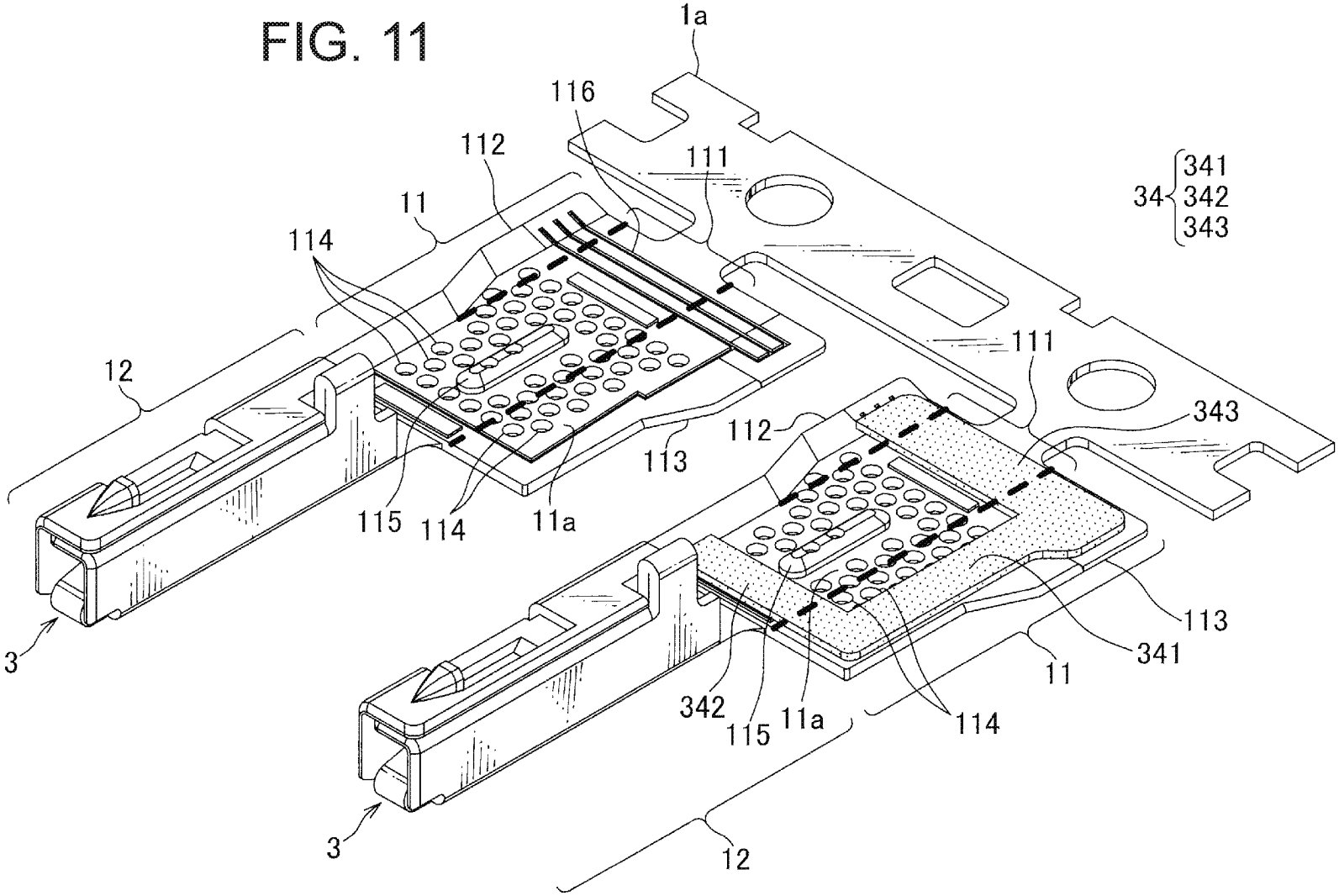
FIG. 11 shows a crimp terminal of a second modified example with respect to the crimp terminal of the first embodiment shown in FIGS. 1-8.
Figure 12:
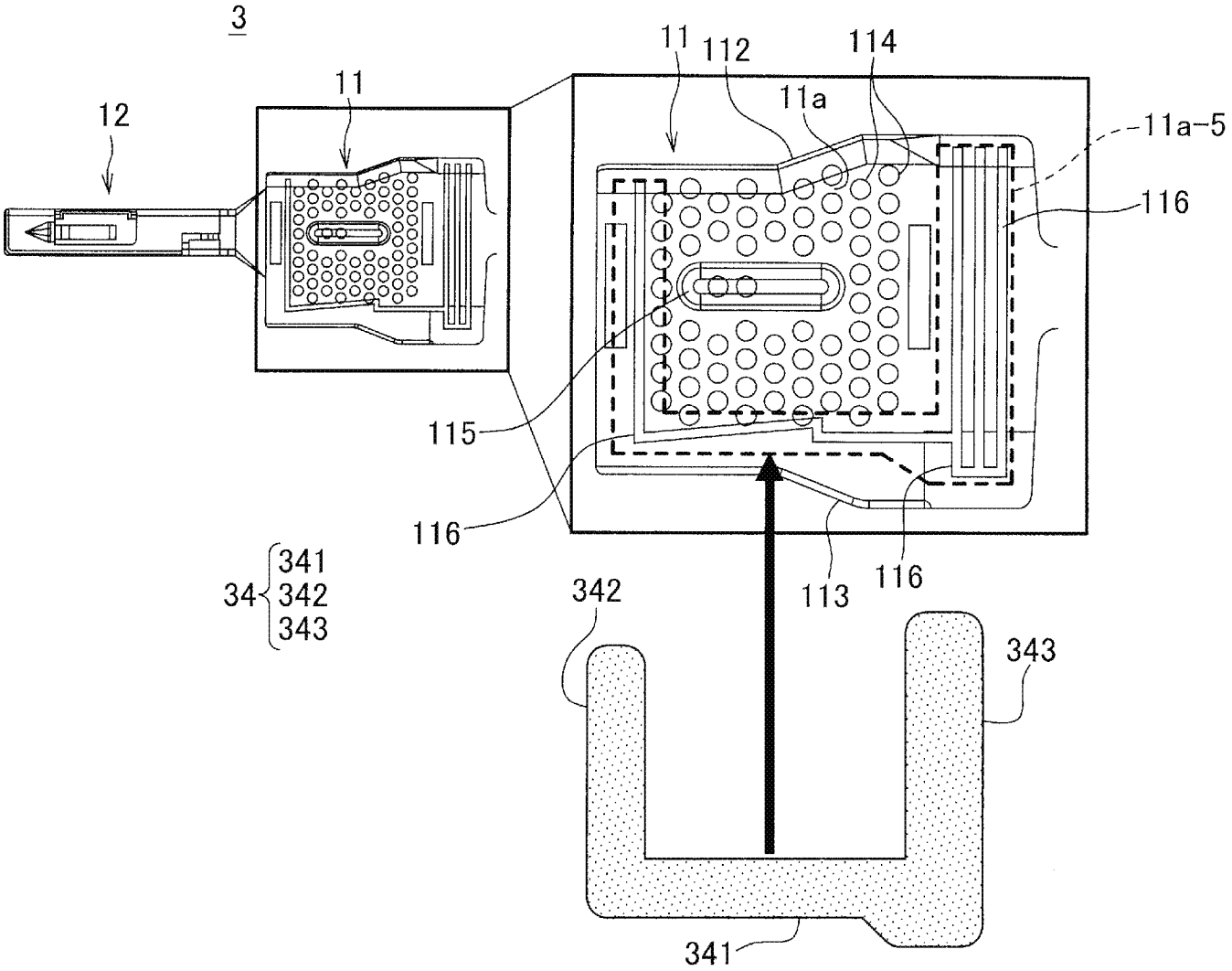
FIG. 12 is a schematic diagram illustrating how a seal member shown in FIG. 11 is attached to an inner surface of a barrel portion.

FIG. 11 illustrates a crimp terminal of a second modified example with respect to the crimp terminal of the first embodiment shown in FIGS. 1-8, and FIG. 12 is a schematic diagram illustrating how a seal member shown in FIG. 11 is attached to an inner surface of a barrel portion. In FIGS. 11 and 12 also, elements similar to those shown in FIGS. 1-8 are denoted by the same reference signs as FIGS. 1-8, and explanation of these similar elements is omitted in the following description. In FIG. 11, two crimp terminals 3 are shown, of which one crimp terminal 3 is shown with a seal member 34 removed for the purpose of providing a view of shape of an inner surface of the barrel portion 11.

In this crimp terminal 3 of the second modified example, the seal member 34 is not divided, and is formed into a C-like shape in a plan view with a second seal portion 342 and a third seal portion 343 extending from and integrally connected with a first seal portion 341 in a two arms fashion. This seal member 34 is attached to a region 11*a*-5 having a C-like shape in a plan view, so as to overlap with the grooves 116 on the inner surface 11*a* of the barrel portion 11 and with a part of the plurality of recesses 114. After the crimping, the first seal portion 341 seals a space between the inner barrel piece 112 and the outer barrel piece 113, and the second seal portion 342 seals the opening of the tubular barrel portion 11 on the side of the terminal portion 12, and the third seal portion 343 seals a space between the covered portion W12 and the barrel portion 11.

As compared to this second modified example, the crimp terminal 1 of the first embodiment described above can facilitate the attaching of the seal member 14 which is divided into three pieces and attached piece by piece. Thus, according to the crimp terminal of this embodiment, difficulty of manufacturing can be reduced while ensuring waterproof property with respect to the contact portion with the aluminum core wire W1*a*.

Moreover, in the crimp terminal 1 of this embodiment, since the seal member 14 is a sheet made of an adhesive gel having a predetermined thickness, an amount of the gel required to appropriately seal the above-described portions can be adjusted easily and accurately during the manufacture, based on an area of the seal member 14. In this sense also, the crimp terminal 1 of this embodiment can reduce difficulty of manufacturing while ensuring waterproof property at a high level, as compared to a case such as applying gel-like resin material for sealing.

In the crimp terminal 1 of this embodiment, the divided seal member 14 is elongated by the crimping and connected, as explained above with reference to FIG. 7. A rate of elongation by the crimping is greater in the intersecting direction D12 than in the axial direction D11. In the crimp terminal 1 of this embodiment, since the seal member 14 is divided in a manner traversing the above-described path 11*a*-4 in the axial direction D11, the divided portion will be connected during the crimping due to the elongation in the intersecting direction D12 along which the rate of elongation is greater. Therefore, even more improved waterproof property can be ensured.

Furthermore, in the crimp terminal 1 of this embodiment, the seal member 14 is attached in a very simple shape that is a shape of a single strip including all of the first seal portion 141, the second seal portion 142 and the third seal portion 143. Thus, the crimp terminal 1 of this embodiment can further reduce difficulty of manufacturing.

Furthermore, in the crimp terminal 1 of this embodiment, the grooves 116 are formed on the inner surface 11*a* of the barrel portion 11 so as to overlap with the seal member 14, and the plurality of recesses 114 is provided so as to avoid the grooves 116. Consequently, movement of the seal member 14 due to the pressure applied during the crimping can be inhibited by the grooves 116 overlapping with the seal member 14. Therefore, the crimp terminal 1 of this embodiment can reduce difficulty of manufacturing while ensuring waterproof property at a higher level.

Further, the groove 116 provided on the inner surface 11*a* of the barrel portion 11 contributes to ensure waterproof property at a high level also in the following respect.

Figure 13:
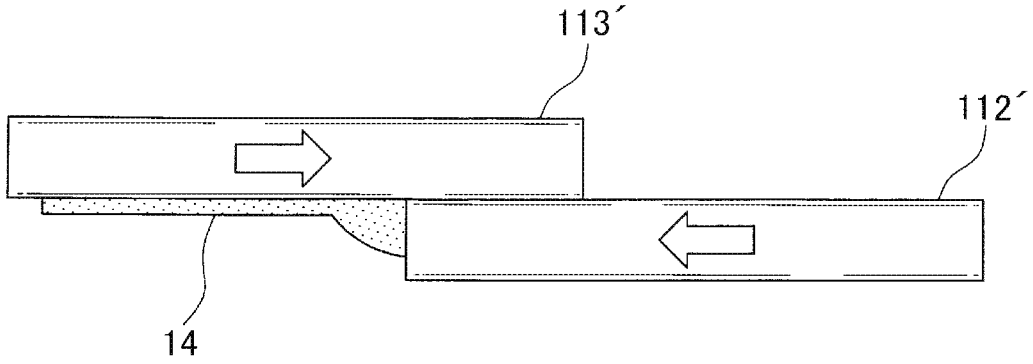
FIG. 13 is a schematic diagram showing an example in which grooves are not provided on the inner surface of the barrel portion, as a comparative example to explain that the grooves provided on the inner surface of the barrel portion contribute to ensure waterproof property at a high level.
Figure 14:
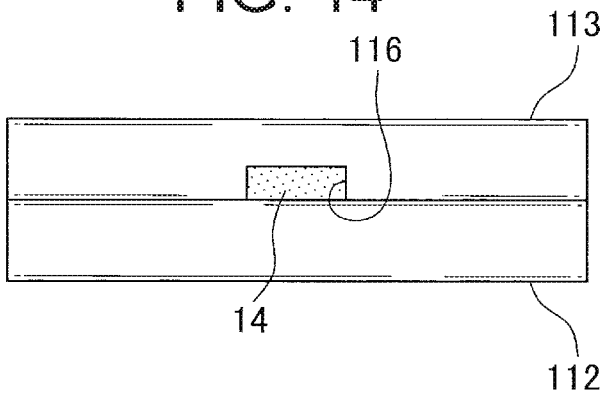
FIG. 14 illustrates that the grooves provided on the inner surface of the barrel portion contribute to ensure waterproof property at a high level, in comparison with the example of FIG. 13.

FIG. 13 is a schematic diagram showing an example in which the groove is not provided on the inner surface of the barrel portion, as a comparative example to explain that the groove provided on the inner surface of the barrel portion contributes to ensure waterproof property at a high level. FIG. 14 illustrates that the groove provided on the inner surface of the barrel portion contributes to ensure waterproof property at a high level in comparison with the example of FIG. 13.

In the comparative example shown in FIG. 13, the seal member 14 attached to an outer barrel piece 113' may be moved to one side by an edge of an inner barrel piece 112' during the crimping. In contrast, as shown in FIG. 14, with the groove 116 provided so as to overlap with the seal member 14, at least a part of the seal member 14 is secured inside the groove 116 even if the seal member 14 is moved to one side. In this manner, the groove 116 provided on the inner surface 11*a* of the barrel portion 11 contributes to ensure waterproof property at a high level.

Furthermore, according to the terminal manufacturing method of the first embodiment that has been described with reference to FIGS. 1 and 2, the seal member 14 is attached with the seal member 14 being divided up, thereby reducing difficulty of manufacturing while ensuring waterproof property with respect to the contact portion with the aluminum core wire W1*a*. In addition, according to the terminal manufacturing method of this embodiment, since the seal member 14 is formed of an adhesive gel sheet, difficulty of manufacturing can be reduced while ensuring waterproof property at a high level.

As described above, in the crimp terminal 1 of this embodiment, the edge of each recess 114 provided on the inner surface 11*a* of the barrel portion 11 bites into the aluminum core wire W11, and by which good electrical continuity between the covered electric wire W1 and the crimp terminal 1 is obtained. That is, the plurality of recesses 114 is dispersedly provided, thereby forming a serration on the inner surface 11*a* of the barrel portion 11. Degree of electrical continuity at the serration is determined by sum of lengths of portions which bite into the aluminum core wire W11 per unit area.

Figure 15:
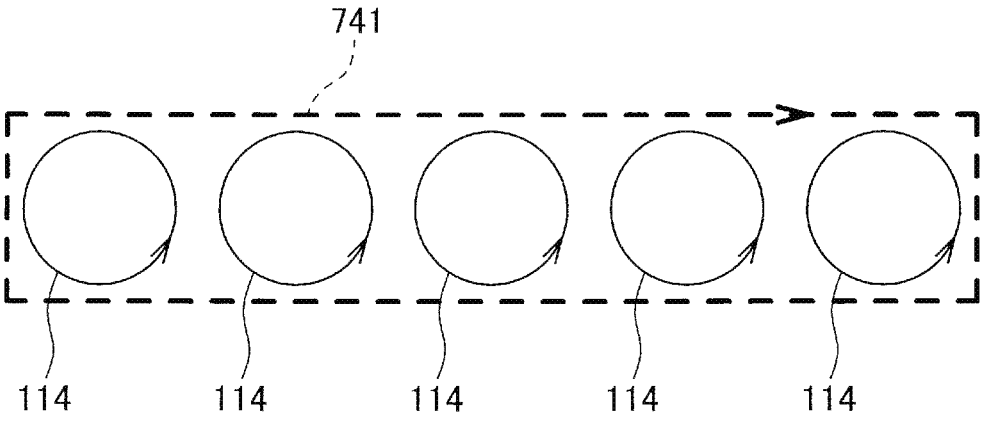
FIG. 15 is a schematic diagram showing the crimp terminal shown in FIGS. 1-8 and showing that a degree of electrical continuity with the aluminum core wire is determined by the sum of lengths of portions which bite into the aluminum core wire per unit area.

FIG. 15 is a schematic diagram showing the crimp terminal shown in FIGS. 1-8 and showing that a degree of electrical continuity with the aluminum core wire is determined by the sum of lengths of portions which bite into the aluminum core wire per unit area.

Figure 49:
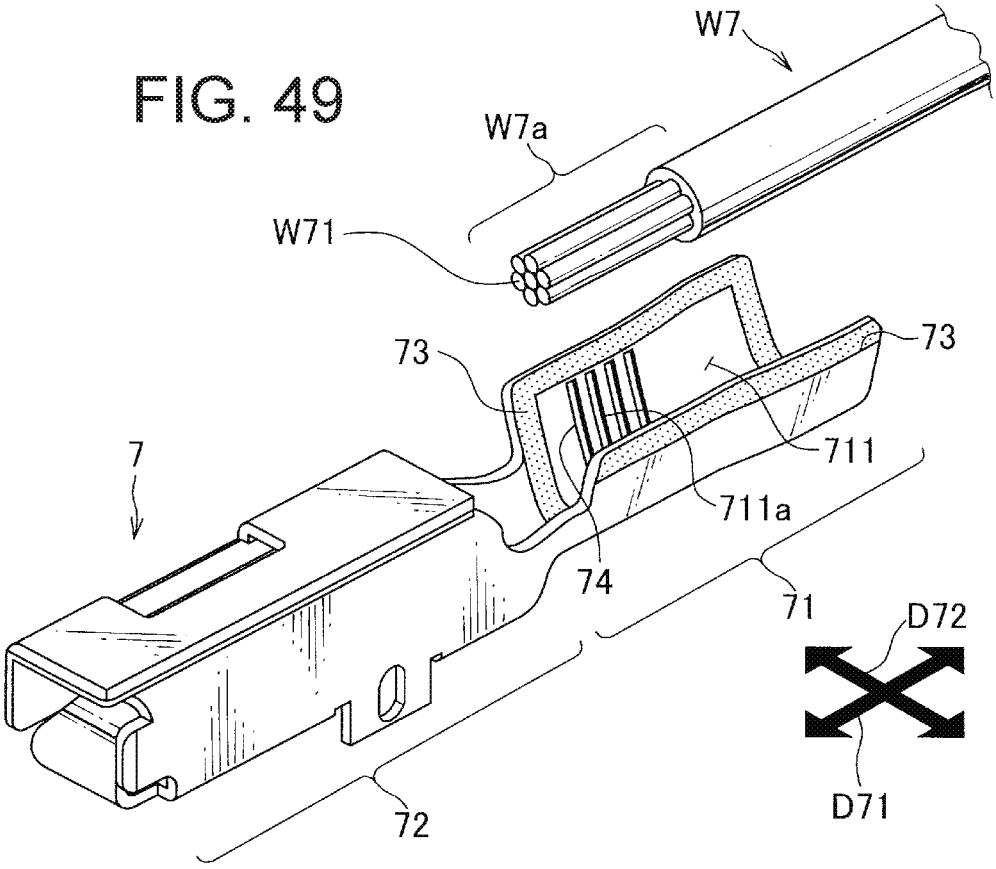
FIG. 49 shows an example of a conventional crimp terminal in which a contact portion between a barrel portion and an aluminum core wire is surrounded by a seal member.

In the crimp terminal 1, the sum of lengths of portions that bite into the aluminum core wire W11 corresponds to sum of perimeters of the recesses 114 formed into a circular shape. In contrast, for example, in the serration 74 shown in FIG. 49 that is constituted of a groove 741, it is the sum of lengths of edges of the linearly extending groove 741, and, considering this sum in terms of per unit area, the sum of perimeters of the plurality of recesses 114 formed into a circular shape is greater. In other words, according to the crimp terminal 1 of this embodiment, an area of the serration required to obtain good electrical continuity between the covered electric wire W11 and the crimp terminal 1 can be reduced compared to, for example, the conventional crimp terminal 7 shown in FIG. 49. By virtue of the reduction in the area of the serration, it is possible to provide a wide space for providing the seal member 14 for ensuring waterproof property with respect to the contact portion with the aluminum core wire W11, reducing difficulty of manufacturing. Consequently, in this respect also, the crimp terminal 1 of this embodiment can reduce difficulty of manufacturing while ensuring waterproof property with respect to the contact portion with the aluminum core wire W11.

Furthermore, the circular recess 114 has a resistance force against a force to expand the recess 114 in an in-plane direction of the inner surface 11*a* of the barrel portion 11 is stronger compared to, for example, a linear groove. Pressure applied to the barrel portion 11 during the crimping is force acting in the in-plane direction of the inner surface 11*a* of the barrel portion 11, and in the crimp terminal 1 of this embodiment, the resistance force at each recess against such pressure is strong.

Figure 16:
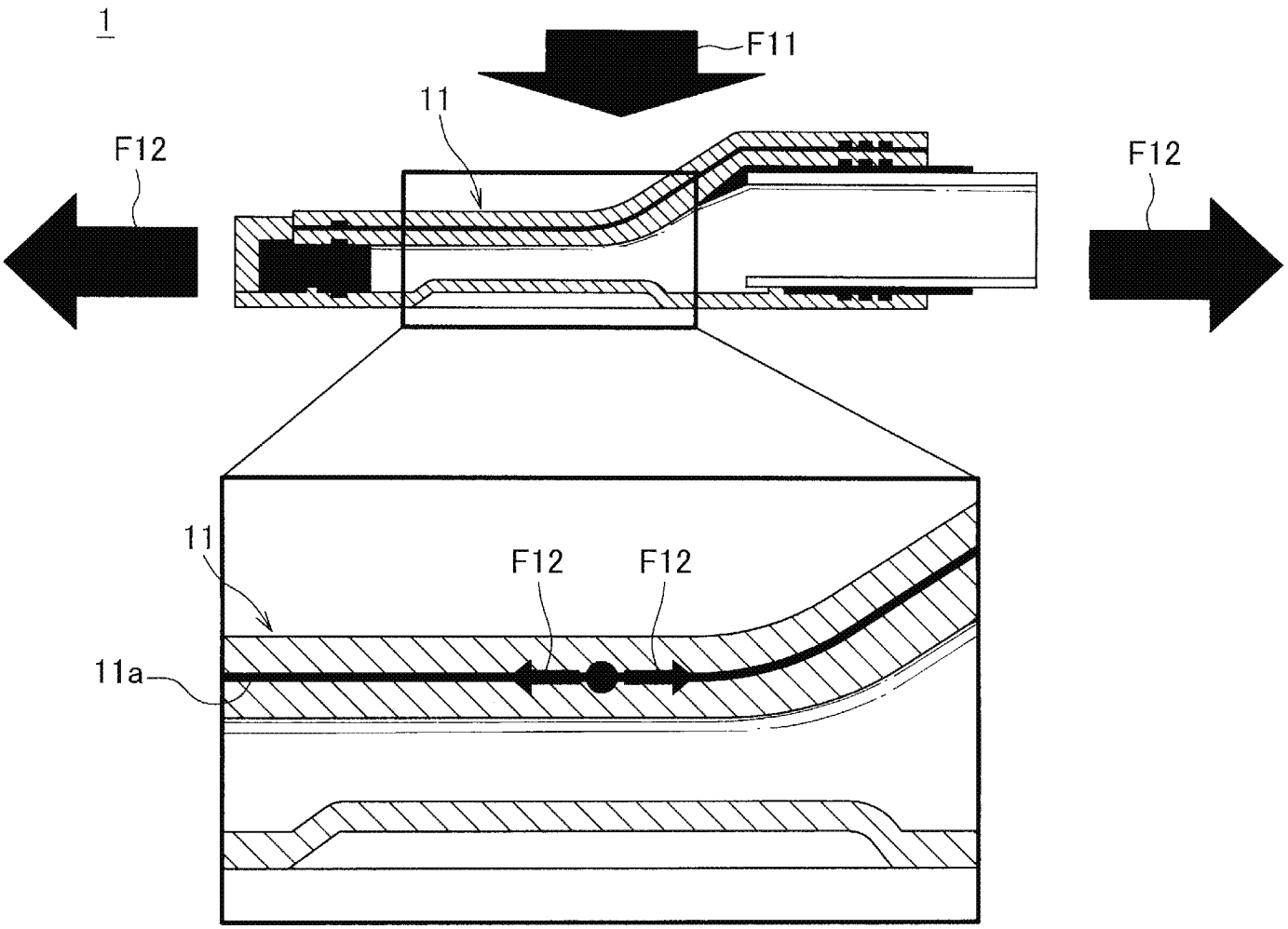
FIG. 16 is a schematic diagram illustrating pressure applied to the barrel portion during the crimping.

FIG. 16 is a schematic diagram illustrating pressure applied to the barrel portion during the crimping.

As shown in FIG. 16, during the crimping, a force F11 to crush the barrel portion 11 of the crimp terminal 1 is applied to the barrel portion 11 by a press machine or the like not shown. When such force F11 is applied, a force F12 to expand the recess 114 in the in-plane direction of the inner surface 11*a* is generated at the barrel portion 11.

Figure 17:
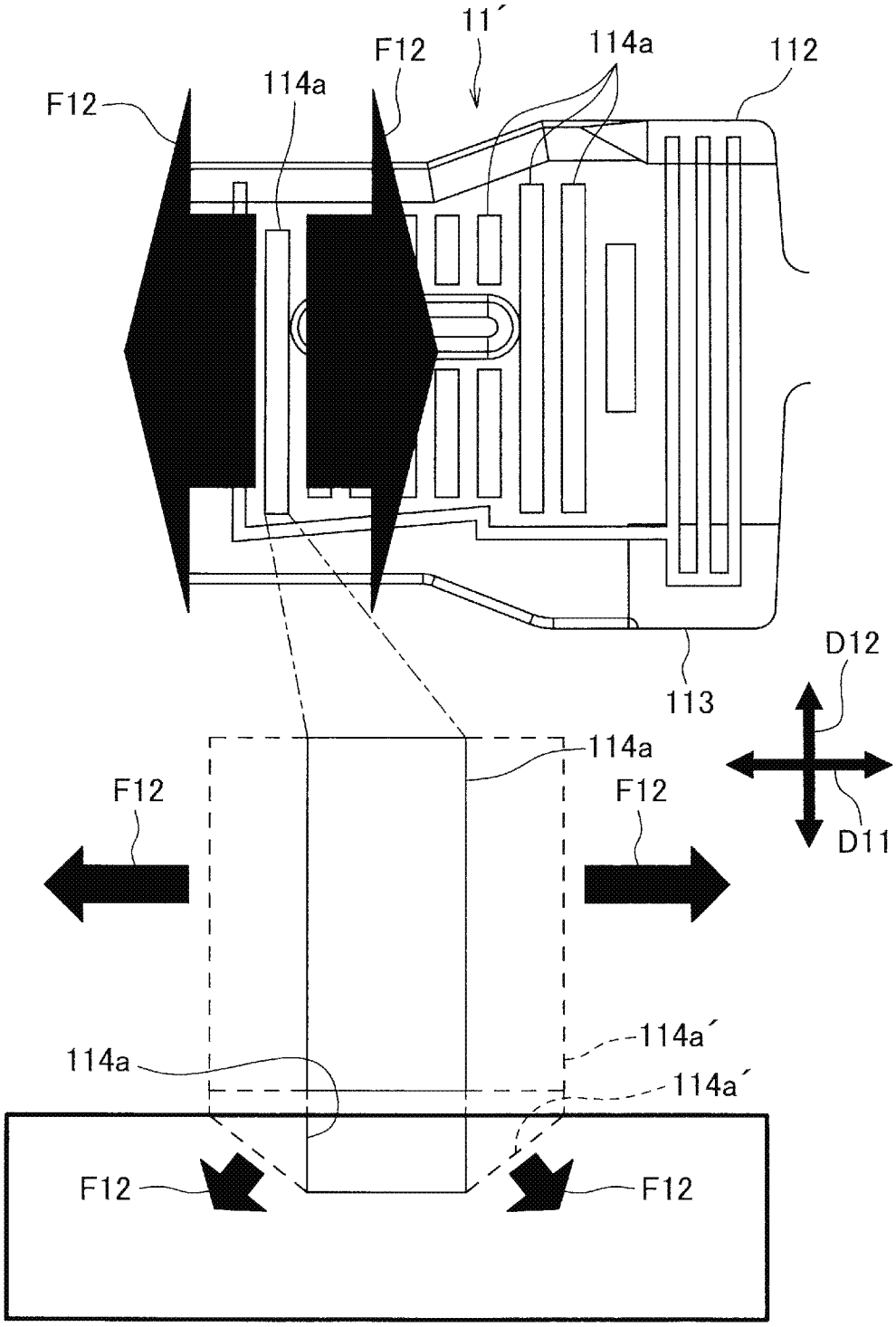
FIG. 17 shows a comparative example in which the barrel portion is provided with a linear groove in place of a recess, and illustrates an effect of a force generated on the barrel portion during the crimping.

FIG. 17 shows a comparative example in which the barrel portion is provided with a linear groove in place of a recess, and illustrates an effect of a force generated on the barrel portion during the crimping. In FIG. 17, elements similar to those shown in FIGS. 1-8 are denoted by the same reference signs as FIGS. 1-8, and explanation of these similar elements is omitted in the following description.

In the comparative example of FIG. 17, a plurality of parallely-arranged linear grooves 114*a* is provided to serve as the serration, in place of the circular recesses 114 of the crimp terminal 1 of the first embodiment. Each groove 114*a* is provided along the intersecting direction D12 intersecting with the axial direction D11. In this comparative example, when the force F12 in the in-plane direction as shown in FIG. 16 is applied, each groove 114*a* is deformed into a deformed groove 114*a'* having a broadened width. With each groove 114*a* deformed into the deformed groove 114*a'*, a barrel portion 11' is elongated in the axial direction D11. In this case, the seal member 14 provided to the barrel portion 11' is correspondingly elongated, and if this elongation is too great, unevenness of the seal member 14 and such is produced for example in the seal member 14 located between the inner barrel piece 112 and the outer barrel piece 113, creating a risk of lowering of waterproof property.

In contrast to this comparative example, the crimp terminal 1 of the first embodiment has strong resistance force against the force F12 to expand the recess 114 in the in-plane direction of the inner surface 11*a*.

Figure 18:
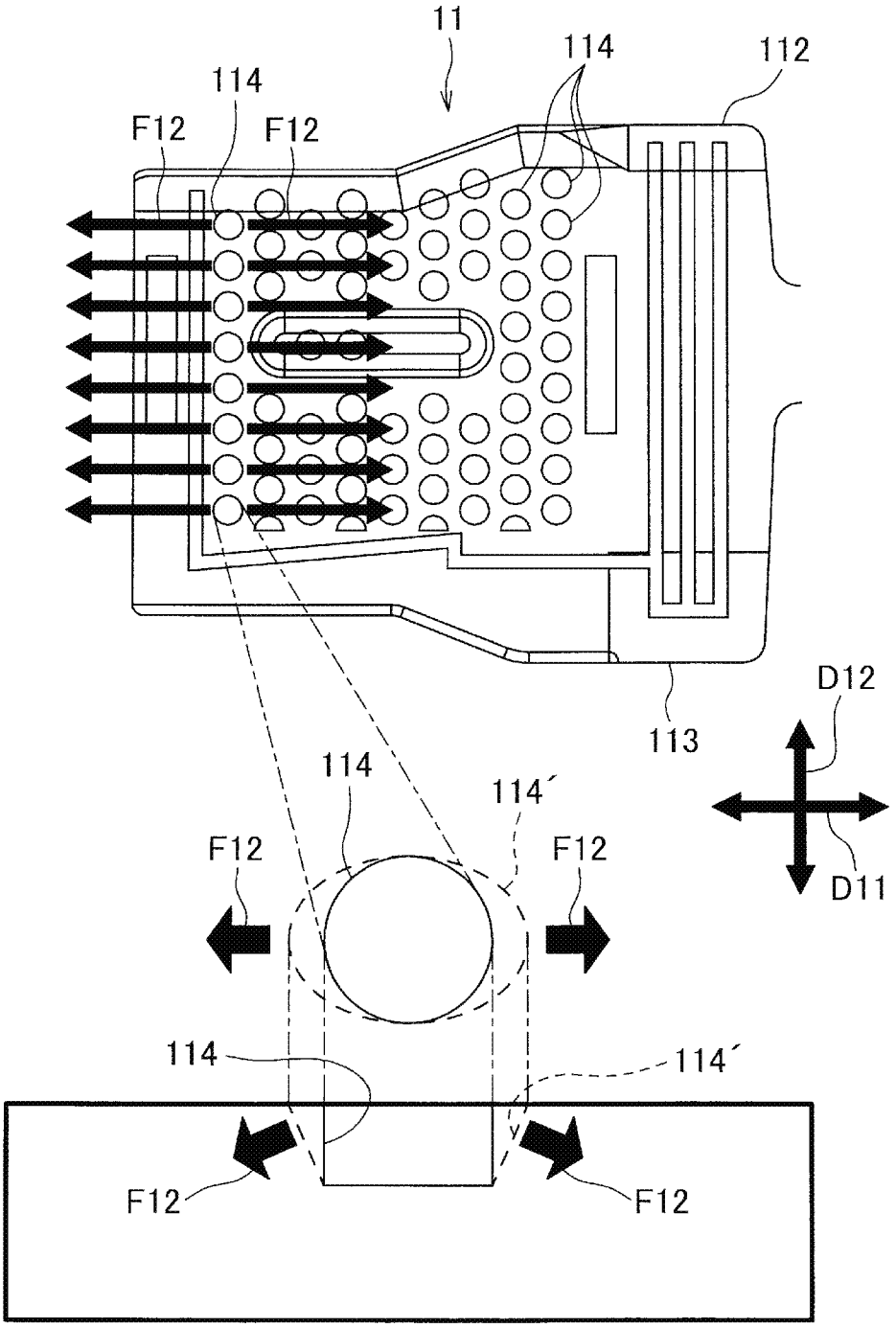
FIG. 18 illustrates that a resistance force against a force to expand the recess is strong in the crimp terminal of the first embodiment.

FIG. 18 illustrates that the crimp terminal of the first embodiment has strong resistance force against the force to expand the recess.

In the circular recess 114, large part of an inner peripheral surface intersects obliquely with the force F12, which serves to inhibit the deformation to expand the recess 114. As such, in the crimp terminal 1 of this embodiment, the elongation of the barrel portion 11 due to the pressure F11 applied during the crimping is inhibited. As a result, the elongation of the seal member 14 is also inhibited, thereby ensuring waterproof property at a high level. In this respect also, the crimp terminal 1 of this embodiment can reduce difficulty of manufacturing while ensuring waterproof property with respect to the contact portion with the aluminum core wire W1*a*.

In the following, modified examples of the recess 114 provided on the inner surface 11*a* of the barrel portion 11 will be described as other modified examples of the above-described first modified example and the second modified example with respect to the crimp terminal 1 of the first embodiment.

Figure 19:
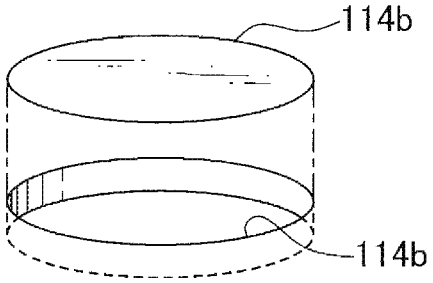
FIG. 19 shows a recess of a third modified example with respect to the crimp terminal of the first embodiment shown in FIGS. 1-8.
Figure 20:
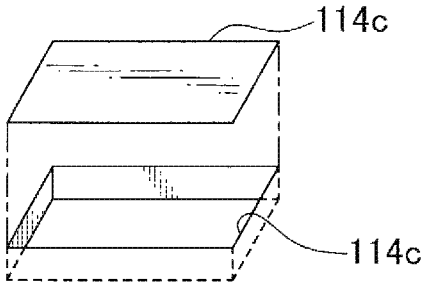
FIG. 20 shows a recess of a fourth modified example with respect to the crimp terminal of the first embodiment shown in FIGS. 1-8.
Figure 21:
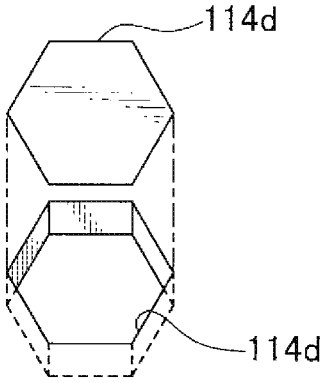
FIG. 21 shows a recess of a fifth modified example with respect to the crimp terminal of the first embodiment shown in FIGS. 1-8.

FIG. 19 shows a recess of a third modified example with respect to the crimp terminal of the first embodiment shown in FIGS. 1-8. FIG. 20 shows a recess of a fourth modified example with respect to the crimp terminal of the first embodiment shown in FIGS. 1-8. FIG. 21 shows a recess of a fifth modified example with respect to the crimp terminal of the first embodiment shown in FIGS. 1-8.

A recess 114*b* in the third modified example shown in FIG. 19 is formed into an oval shape in a plane view. A recess 114*c* in the fourth modified example shown in FIG. 20 is formed into a parallelogram in a plane view. A recess 114*d* in the fifth modified example shown in FIG. 21 is formed into a hexagonal shape in a plane view.

Other modified examples of the recess 114 of the crimp terminal 1 of the first embodiment may include those having other shapes such as a triangular shape or other polygonal shapes in a plane view. Any one of these modified examples has the resistance force against the force F12 to expand in the in-plane direction of the inner surface 11*a* that is strong compared to the linear groove 114*a* shown in FIG. 17. The oval recess 114*b* of the third modified example has substantially the same strength as the circular recess 114 of the first embodiment, whereas the parallelogram shaped recess 114*c* of the fourth modified example and the hexagonal shaped recess 114*d* of the fifth modified example have a weaker resistance force compared to the circular recess 114 of the first embodiment or the oval recess 114*b* of the third modified example.

As described above, in the crimp terminal 1 of the first embodiment, a part of the plurality of recesses 114 provided on the inner surface 11*a* of the barrel portion 11 overlap with the seal member 14. In this respect, the crimp terminal 1 of the first embodiment has the following advantageous effects.

Figure 22:
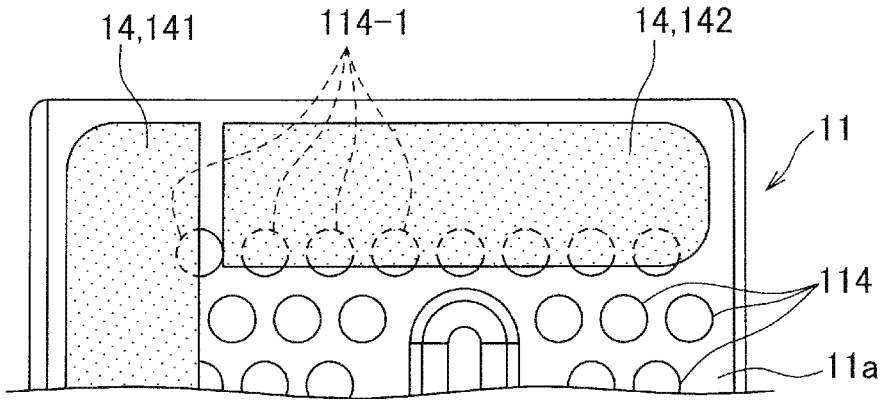
FIG. 22 illustrates an advantageous effect of arranging a part of a plurality of recesses to overlap with the seal member.

FIG. 22 illustrates an advantageous effect of arranging a part of the plurality of recesses to overlap with the seal member.

In the crimp terminal 1 of the first embodiment, of the seal member 14, firstly, the first seal portion 141 attached to the outer barrel piece 113 side partially overlap with a recess 114-1 located closest to the edge of the outer barrel piece 113. As such, the recess 114-1 at a location to be overlapped with the first seal portion 141 can be used as a mark when providing the first seal portion 141 to the inner surface 11*a* of the barrel portion 11. Further, the second seal portion 142 attached to the terminal portion 12 side partially overlap with the recesses 114-1 located closest to the terminal portion 12. As such, the recess 114-1 at a location to be overlapped with the second seal portion 142 can be used as a mark when providing the second seal portion 142 to the inner surface 11*a* of the barrel portion 11. In these respects, the crimp terminal 1 of this embodiment can reduce difficulty of manufacturing. In addition, the recesses 114-1 overlapped with the first seal portion 141 and the second seal portion 142 inhibit the movement of the first seal portion 141 and the second seal portion 142 due to the pressure applied during the crimping, thereby contributing to ensure waterproof property at a higher level. Thus, according to the crimp terminal 1 of this embodiment, difficulty of manufacturing can be reduced by utilizing a part of the recesses 114 provided to obtain good electrical continuity between the covered electric wire W1 and the crimp terminal 1, while ensuring waterproof property with respect to the contact portion with the aluminum core wire W11.

Moreover, according to the crimp terminal 1 of the first embodiment, the movement of the seal member 14 due to the pressure applied during the crimping is inhibited also by the groove 116 overlapped with the seal member 14. In this respect, the crimp terminal 1 of the first embodiment can reduce difficulty of manufacturing while ensuring waterproof property at a higher level. In addition, the groove 116 to be overlapped with the seal member 14 can also be used as a mark when providing the seal member 14 to the inner surface 11*a* of the barrel portion 11, thereby further reducing difficulty of manufacturing.

Furthermore, in the crimp terminal 1 of the first embodiment, the plurality of recesses 114 forms the serration to ensure high degree of electrical continuity, as described above. Thus, even if the seal member 14 is overlapped with slightly large part of the recesses 114, the effect on the electrical continuity is small. Consequently, when attaching the seal member 14, positioning does not need to be performed so accurately, and in this respect also, difficulty of manufacturing can be reduced even more.

Next, modified examples of the seal member 14 to be attached on the inner surface 11*a* of the barrel portion 11 will be described as other modified examples of the above-described first to fifth modified examples with respect to the crimp terminal 1 of the first embodiment.

Figure 23:
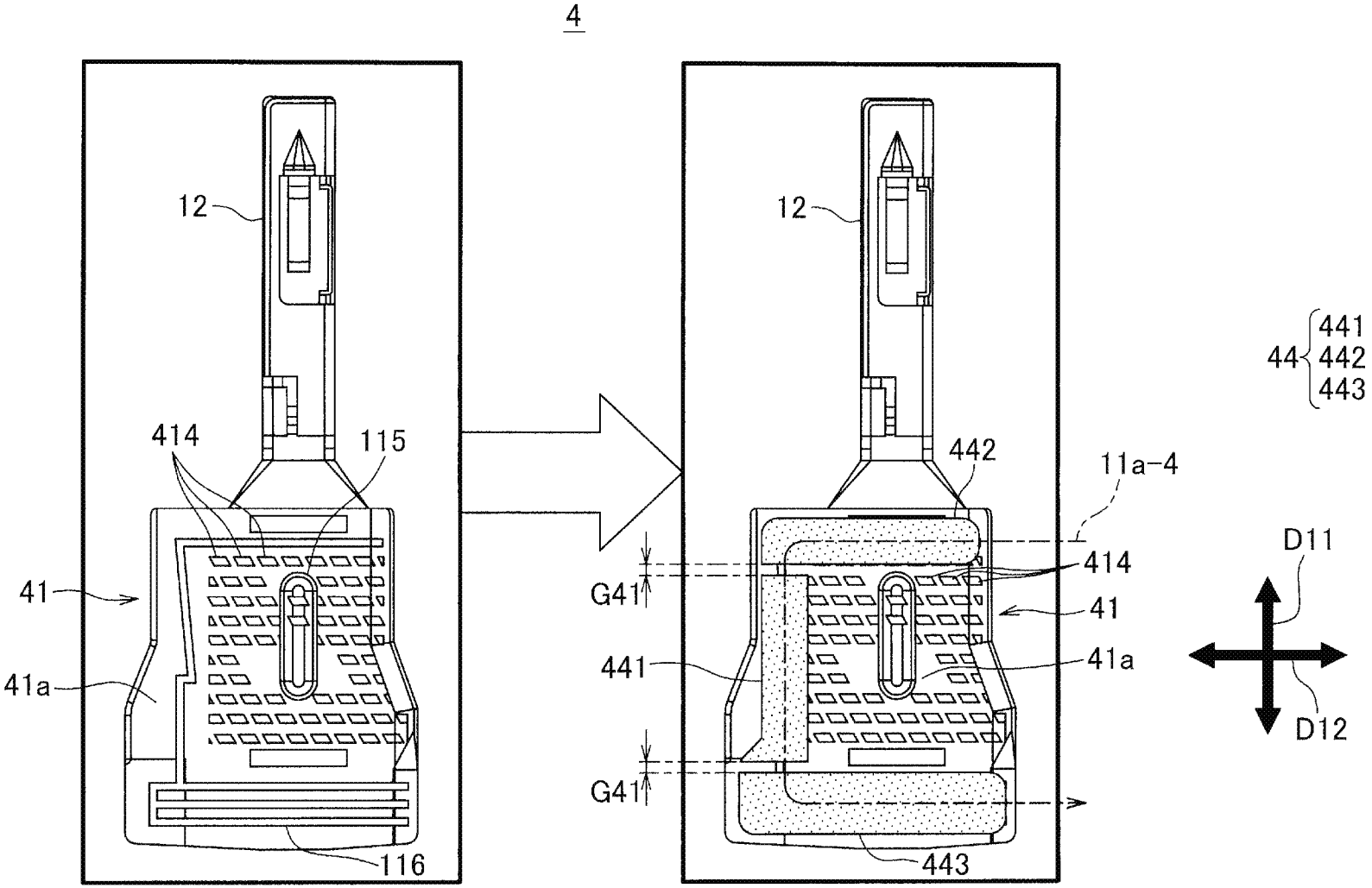
FIG. 23 shows a sixth modified example with respect to the crimp terminal of the first embodiment shown in FIGS. 1-8.

FIG. 23 shows a sixth modified example with respect to the crimp terminal of the first embodiment shown in FIGS. 1-8. In this sixth modified example, not only the shape of the seal member but the shape of the recess is also different from that of the crimp terminal 1 of the first embodiment. In FIG. 23, elements similar to those shown in FIGS. 1-8 are denoted by the same reference signs as FIGS. 1-8, and explanation of these similar elements is omitted in the following description.

In a crimp terminal 4 of the sixth modified example, a recess 414 provided on an inner surface 41*a* of a barrel portion 41 is the recess having a parallelogram shape shown in FIG. 20 as the fourth modified example.

In a seal member 44 of the sixth modified example, each of a second seal portion 442 and a third seal portion 443 is divided from a first seal portion 441 in a manner traversing the above-described path 11*a*-4 in the intersecting direction D12. Slight gaps G41 are formed in the axial direction D11 between the second seal portion 442 and the first seal portion 441, and between the third seal portion 443 and the first seal portion 441. These gaps G41 are closed by the above-described elongation of the seal member 44 during the crimping.

Figure 24:
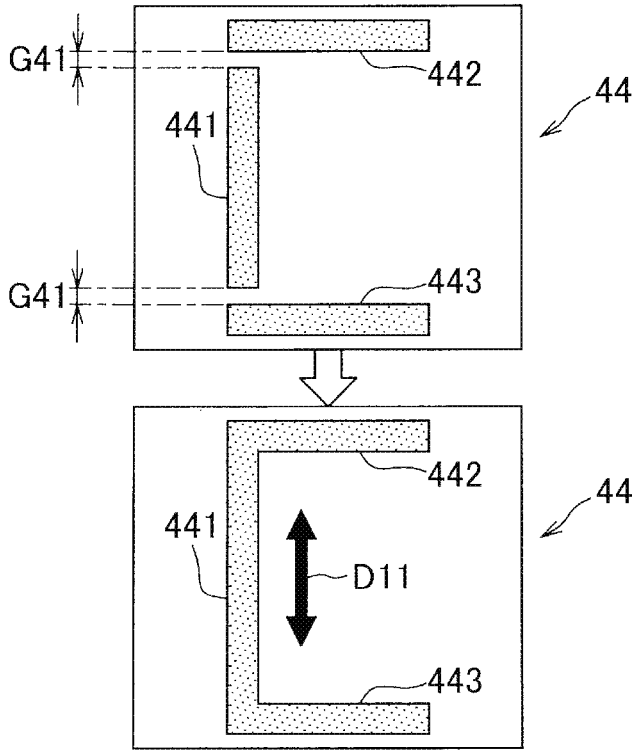
FIG. 24 is a schematic diagram showing how a gap between a second seal portion and a first seal portion and a gap between a third seal portion and the first seal portion shown in FIG. 23 are closed by elongation of a seal member during crimping.

FIG. 24 is a schematic diagram showing how the gap between the second seal portion and the first seal portion and the gap between the third seal portion and the first seal portion shown in FIG. 23 are closed by the elongation of the seal member during crimping.

As shown in FIG. 24, during the crimping, the first seal portion 441 is elongated in the axial direction D11 coincide with a length direction thereof. Due to this elongation, the second seal portion 442 and the third seal portion 443 are connected to the first seal portion 441, thereby closing the above-described gaps G41. A rate of elongation in the crimping is greater in the intersecting direction D12 than in the axial direction D11. Thus, although the degree of elongation is smaller compared to the first embodiment described with reference to FIG. 7, by appropriately adjusting the gaps G41 formed during the attaching, the gaps G41 can be closed during the crimping and the high level waterproof property can be ensured.

Next, further modified examples of shape of the seal member 14 of the first embodiment will be described.

Figure 25:
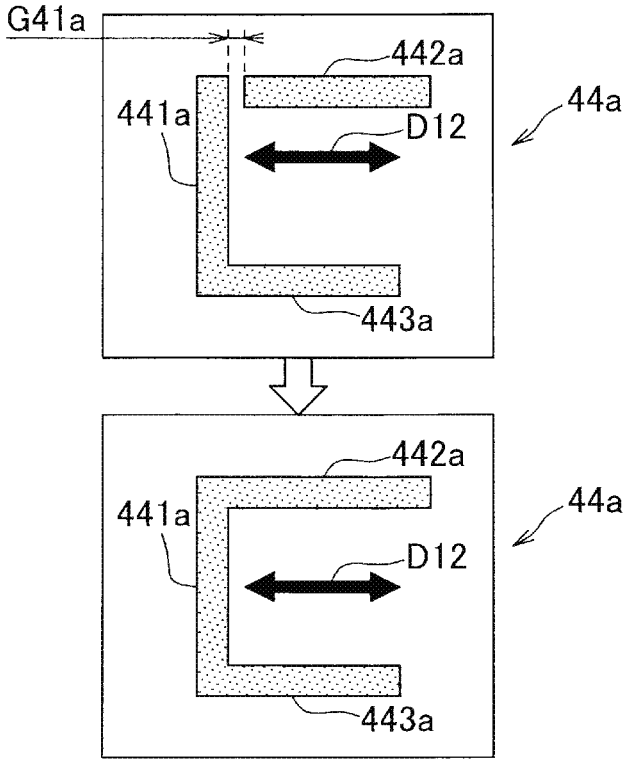
FIG. 25 shows a seal member of a seventh modified example with respect to the crimp terminal of the first embodiment shown in FIGS. 1-8.
Figure 26:
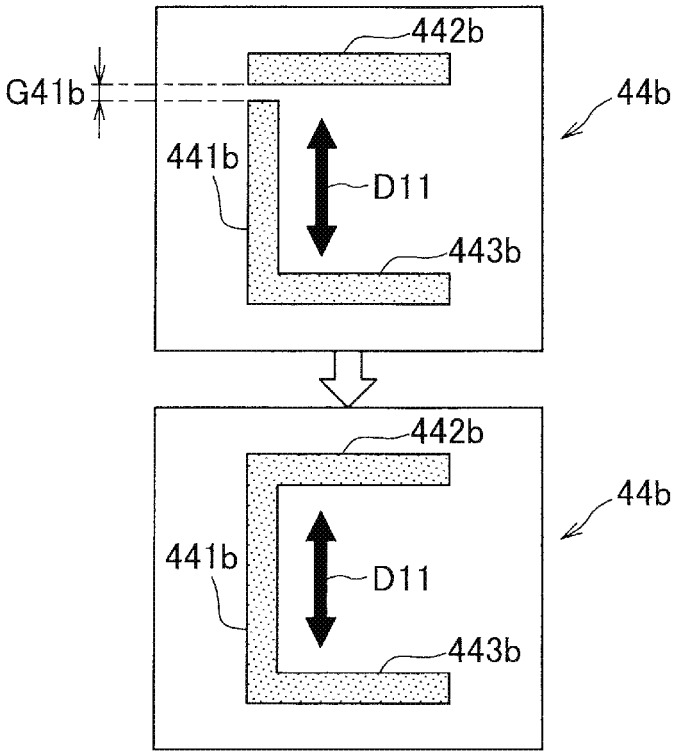
FIG. 26 shows a seal member of an eighth modified example with respect to the crimp terminal of the first embodiment shown in FIGS. 1-8.
Figure 27:
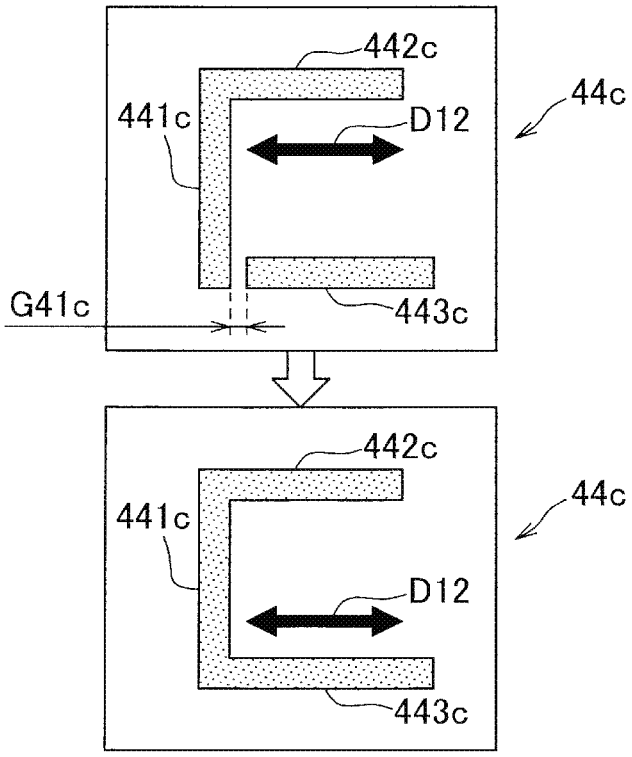
FIG. 27 shows a seal member of a ninth modified example with respect to the crimp terminal of the first embodiment shown in FIGS. 1-8.
Figure 28:
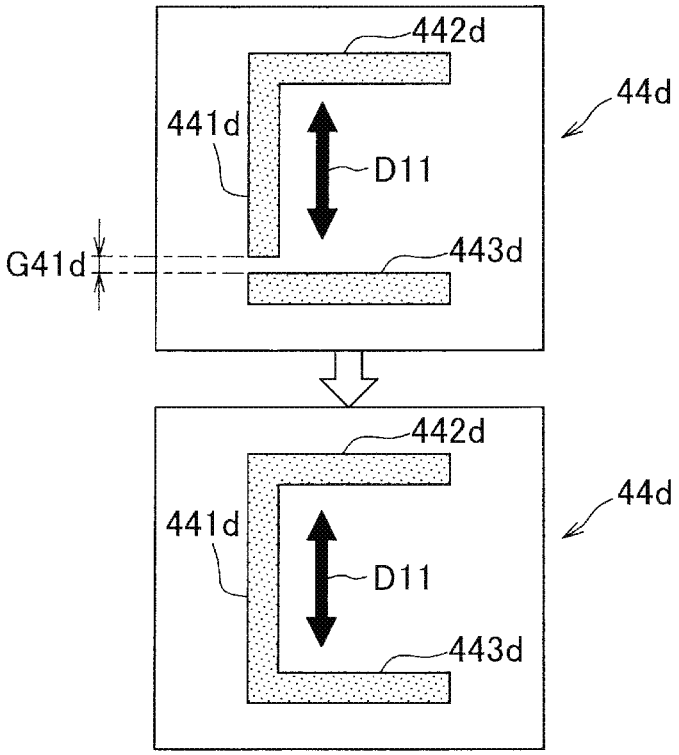
FIG. 28 shows a seal member of a tenth modified example with respect to the crimp terminal of the first embodiment shown in FIGS. 1-8.

FIG. 25 shows a seal member of a seventh modified example with respect to the crimp terminal of the first embodiment shown in FIGS. 1-8. FIG. 26 shows a seal member of an eighth modified example with respect to the crimp terminal of the first embodiment shown in FIGS. 1-8. FIG. 27 shows a seal member of a ninth modified example with respect to the crimp terminal of the first embodiment shown in FIGS. 1-8. FIG. 28 shows a seal member of a tenth modified example with respect to the crimp terminal of the first embodiment shown in FIGS. 1-8.

In a seal member 44*a* of the seventh modified example shown in FIG. 25, a first seal portion 441*a* and a second seal portion 442*a* are divided, forming a gap G41*a* in the intersecting direction D12. On the other hand, the first seal portion 441*a* and a third seal portion 443*a* are connected to each other so that they are formed into a L-like shape in a plane view. That is, this seal member 44*a* is divided into two parts. During the crimping, the second seal portion 442*a* is elongated in the intersecting direction D12. Due to this elongation, the second seal portion 442*a* is connected to the first seal portion 441*a*, thereby closing the above-described gap G41*a*.

In a seal member 44*b* of the eighth modified example shown in FIG. 26, a first seal portion 441*b* and a second seal portion 442*b* are divided, forming a gap G41*b* in the axial direction D11. On the other hand, the first seal portion 441*b* and a third seal portion 443*b* are connected to each other so that they are formed into a L-like shape in a plane view. During the crimping, the first seal portion 441*b* is elongated in the axial direction D11. Due to this elongation, the first seal portion 441*b* is connected to the second seal portion 442*b*, thereby closing the above-described gap G41*b*.

In a seal member 44*c* of the ninth modified example shown in FIG. 27, a first seal portion 441*c* and a third seal portion 443*c* are divided, forming a gap G41*c* in the intersecting direction D12. On the other hand, the first seal portion 441*c* and a second seal portion 442*c* are connected to each other so that they are formed into an inverse L-like shape in a plane view. During the crimping, the third seal portion 443*c* is elongated in the intersecting direction D12. Due to this elongation, the third seal portion 443*c* is connected to the first seal portion 441*c*, thereby closing the above-described gap G41*c*.

In a seal member 44*d* of the tenth modified example shown in FIG. 28, a first seal portion 441*d* and a third seal portion 443*d* are divided, forming a gap G41*d* in the axial direction D11. On the other hand, the first seal portion 441*d* and a second seal portion 442*d* are connected to each other so that they are formed into an inverse L-like shape in a plane view. During the crimping, the first seal portion 441*d* is elongated in the axial direction D11. Due to this elongation, the first seal portion 441*d* is connected to the third seal portion 443*d*, thereby closing the above-described gap G41*d*.

The explanation of the first embodiment including its modified examples is finished here, and next a second embodiment will be explained along with its modified examples. In this second embodiment, a plurality of recesses provided on an inner surface of a barrel portion is different from that of the first embodiment. In the following, the second embodiment will be explained focusing on the difference from the first embodiment.

Figure 29:
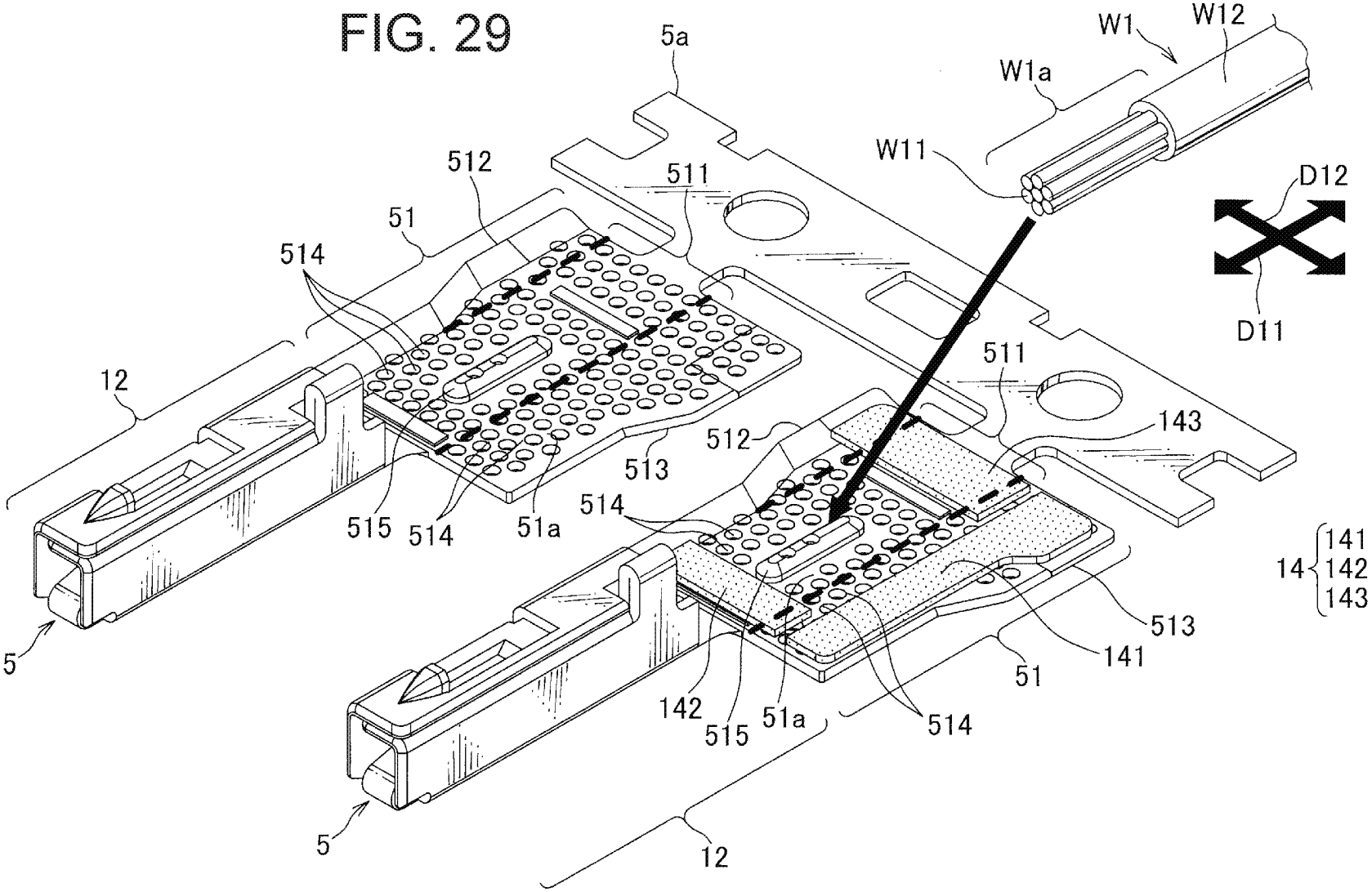
FIG. 29 illustrates a crimp terminal according to a second embodiment of the present invention.
Figure 30:
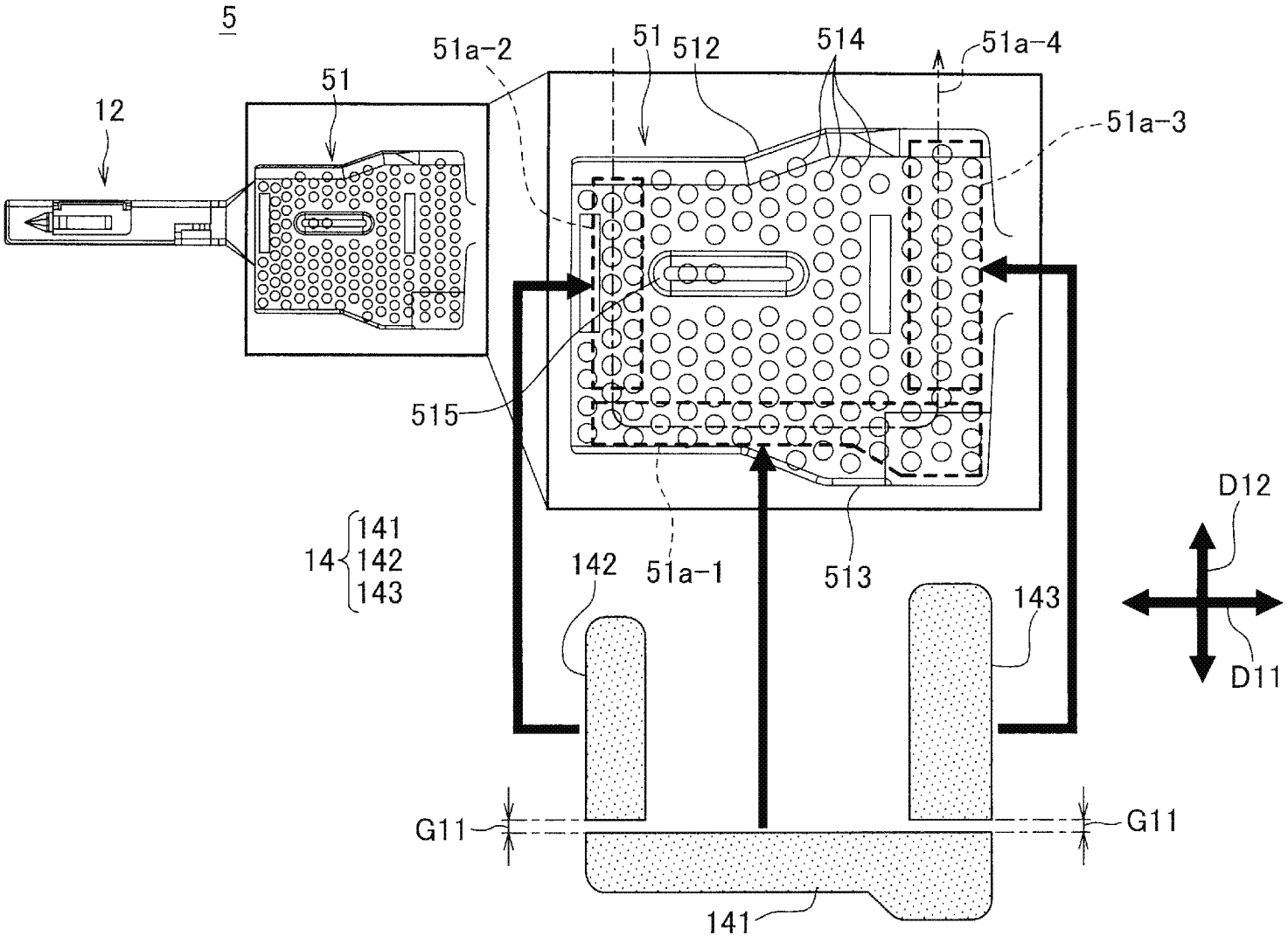
FIG. 30 illustrates how a seal member shown in FIG. 29 is attached to an inner surface of a barrel portion.

FIG. 29 illustrates a crimp terminal according to a second embodiment of the present invention. FIG. 30 illustrates how a seal member shown in FIG. 29 is attached to an inner surface of a barrel portion. In FIGS. 29 and 30, elements similar to those shown in FIGS. 1-8 are denoted by the same reference signs as FIGS. 1-8, and explanation of these similar elements is omitted in the following description. In FIG. 29, two crimp terminals 5 are shown, of which one crimp terminal 5 is shown with a seal member 14 removed for the purpose of providing a view of shape of an inner surface of a barrel portion 51.

In the crimp terminal 5 of this embodiment, a plurality of recesses 514 is dispersedly provided on an inner surface 51*a* of the barrel portion 51 over an entire region including a first region 51*a*-1, a second region 51*a*-2 and a third region 51*a*-3. A protrusion 515 is formed on the inner surface 51*a* at a location where the aluminum core wire W11 is to be placed, and is formed by pressing applied from an outer surface side. The first region 51*a*-1 is a region traversing an outer barrel piece 513 in the axial direction D11. The second region 51*a*-2 is a region that traverses, on a side closer to the terminal portion 12 than the aluminum core wire W11, the inner surface 51*a* of the barrel portion 51 including a bottom plate 511 in the intersecting direction D12 between an inner barrel piece 512 side and the outer barrel piece 513 side. The third region 51*a*-3 is a region that traverses the inner surface 51*a* in the intersecting direction D12, between the inner barrel piece 512 side and the outer barrel piece 513 side, so as to intersect with the covered portion W12 of the end portion W1*a*.

The seal member 14 constituted of the first seal portion 141, the second seal portion 142 and the third seal portion 143 is attached so as to overlap with the recesses 514 at each of the first region 51*a*-1, the second region 51*a*-2 and the third region 51*a*-3. Gaps G11 are formed between the second seal portion 142 and the first seal portion 141 and between the third seal portion 143 and the first seal portion 141, the gaps G11 traversing, in the axial direction D11, a path 51*a*-4 extending from the second region 51*a*-2 through the first region 51*a*-1 to the third region 51*a*-3.

The crimp terminal 5 described above is manufactured using a terminal manufacturing method as described below.

In this terminal manufacturing method, firstly, a sheet-metal processing step for forming a structural object prior to the attachment of the seal member 14 is performed. In the sheet-metal processing step, the barrel portion 51 is formed together with the terminal portion 12 from the metal plate. In this embodiment also, in this sheet-metal processing step, the barrel portion 51 and the terminal portion 12 are collectively formed with the plurality of crimp terminals 5 connected together by the strip-like connecting piece 5*a*. In this sheet-metal processing step, the formation of the plurality of recesses 514 and the formation of the protrusion 515 on the inner surface 51*a* of the barrel portion 51 are also performed.

Subsequently, the seal member attaching step is performed in which the seal member 14 is formed from an adhesive gel sheet, and the seal member 14 is attached over the first region 51*a*-1, the second region 51*a*-2 and the third region 51*a*-3. This seal member attaching step is a step for attaching the seal member 14 in a manner that the seal member 14 is divided in the partway of the path 51*a*-4 described above. In other words, the first seal portion 141, the second seal portion 142 and the third seal portion 143 are individually attached to the inner surface 51*a* of the barrel portion 51.

Similar to the above-described first embodiment, in this embodiment also, in the seal member attaching step, the first seal portion 141, the second seal portion 142 and the third seal portion 143 are punched out from the adhesive gel sheet and attached to the inner surface 51*a* of the barrel portion 51.

The crimp terminal 5 manufactured as described above is crimped to the end portion W1*a* of the covered electric wire W1 as follows.

Figure 31:
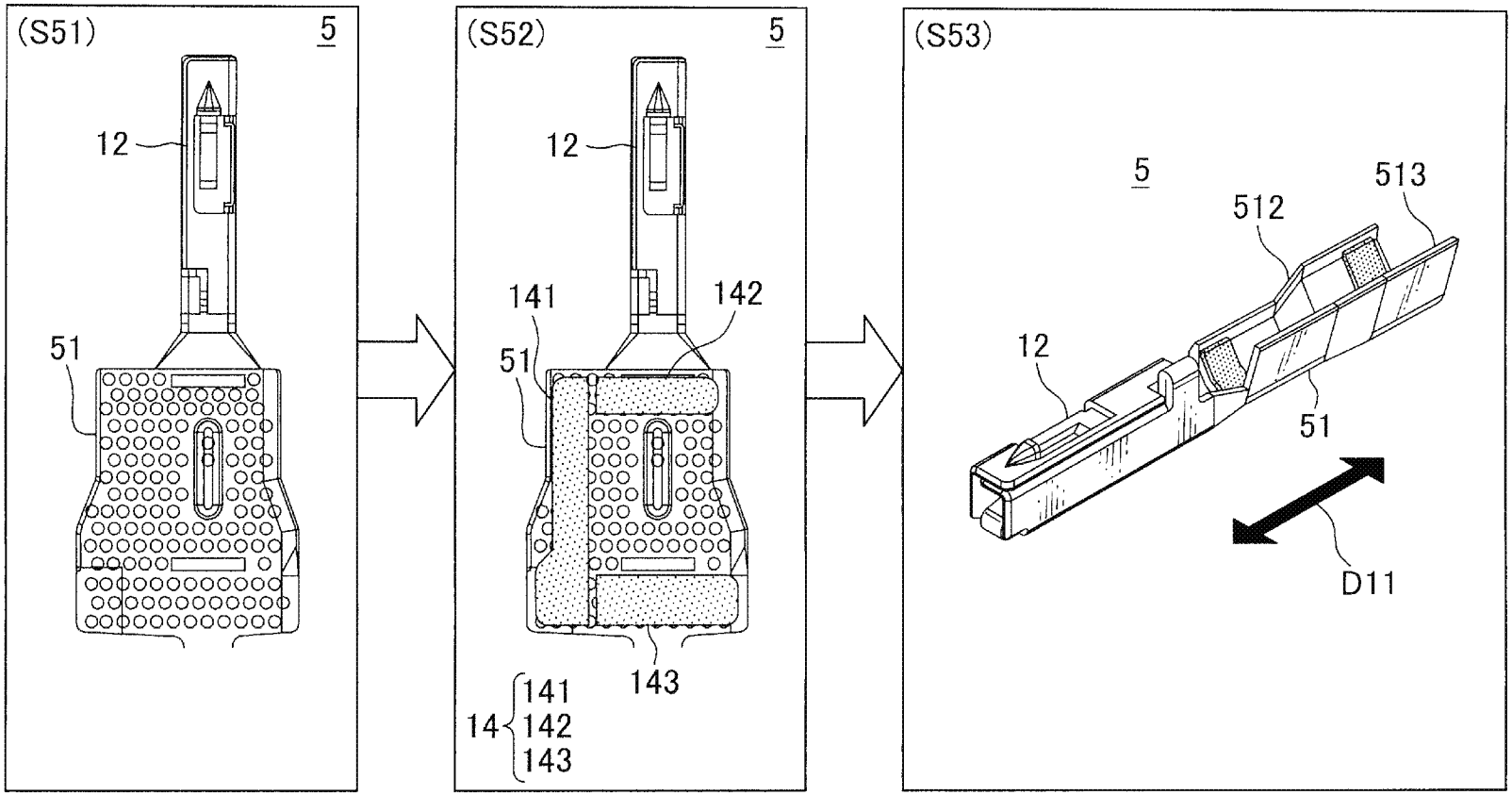
FIG. 31 illustrates a procedure of completing preparation of the crimp terminal shown in FIGS. 29 and 30 that is ready to be crimped to an end portion of a covered electric wire.
Figure 32:
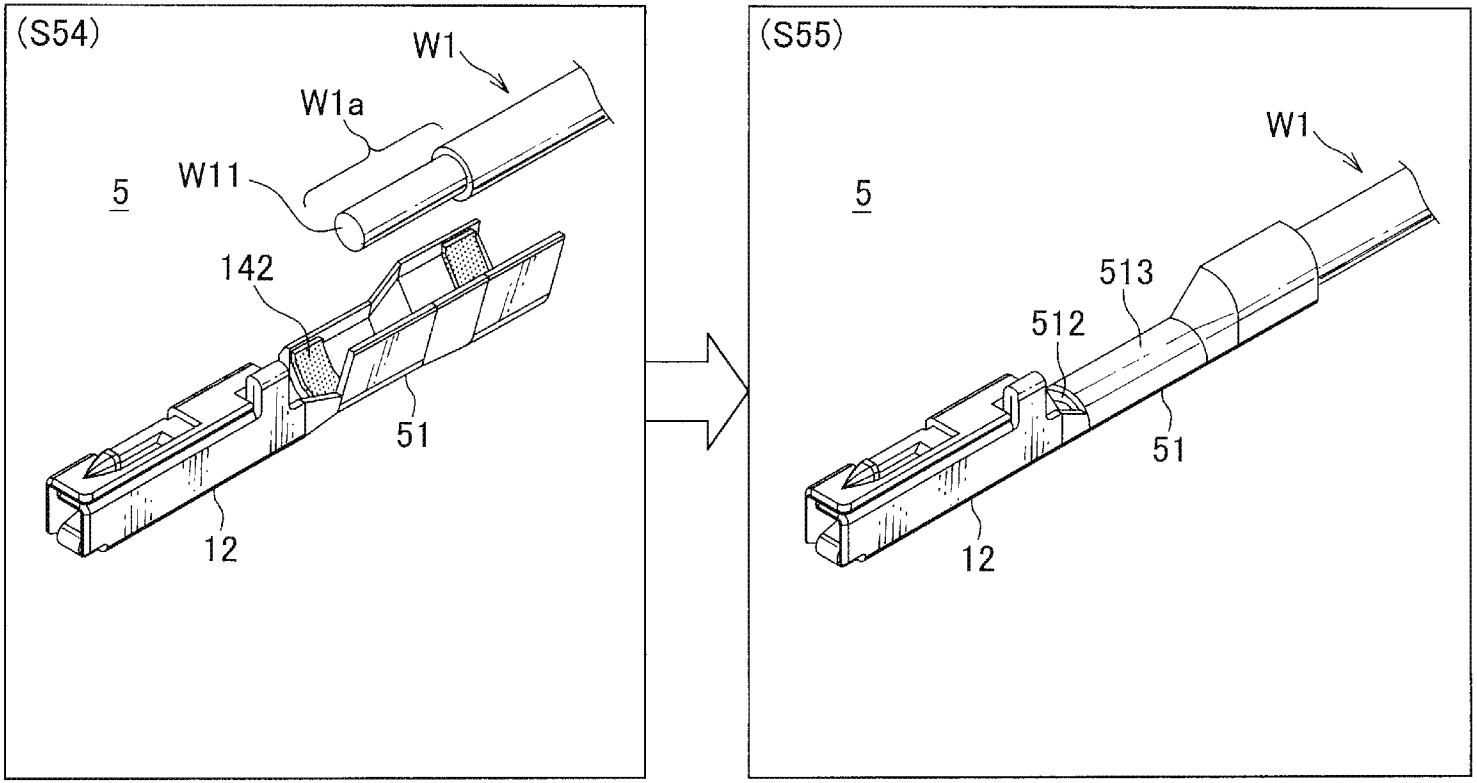
FIG. 32 illustrates a procedure, that follows the procedure shown in FIG. 31, of crimping the crimp terminal to the end portion of the covered electric wire.

FIG. 31 illustrates a procedure of completing preparation of the crimp terminal shown in FIGS. 29 and 30 that is ready to be crimped to an end portion of a covered electric wire. FIG. 32 illustrates a procedure, that follows the procedure shown in FIG. 31, of crimping the crimp terminal to the end portion of the covered electric wire.

FIG. 31 also shows a sheet-metal processing step (S51) and a seal member attaching step (S52) in the terminal manufacturing method described above. The barrel portion 51 and the terminal portion 12 are formed in the sheet-metal processing step (S51), and the first seal portion 141, the second seal portion 142 and the third seal portion 143 constituting the seal member 14 are attached in the seal member attaching step (S52).

When crimping to the end portion W1*a* of the covered electric wire W1, firstly, the crimp terminal 5 to be crimped is detached from the connecting piece 5*a* shown in FIG. 29. Then, this barrel portion 51 is subjected to a bending deformation as preparation for placing the end portion W1*a* of the covered electric wire W1 (S53). This bending deformation is performed such that the inner barrel piece 512 and the outer barrel piece 513 are brought close to each other so that the cross section intersecting with the axial direction D11 is formed into a substantially U-like shape.

Subsequently, the end portion W1*a* of the covered electric wire W1 is placed on the barrel portion 51 that has been subjected to the bending deformation (S54). At this time, the end portion W1*a* is placed such that a tip of the aluminum core wire W11 does not overlap with the second seal portion 142. However, a small overlap between the tip of the aluminum core wire W11 and the second seal portion 142 is allowed. Subsequently, the barrel portion 51 is wound around and crimped to the end portion W1*a* such that the inner barrel piece 512 is arranged inside and the outer barrel piece 513 is placed onto the inner barrel piece 512 (S55).

As a result of such crimping, the seal member 14 seals the respective portions of the crimp terminal 5 as follows.

Figure 33:
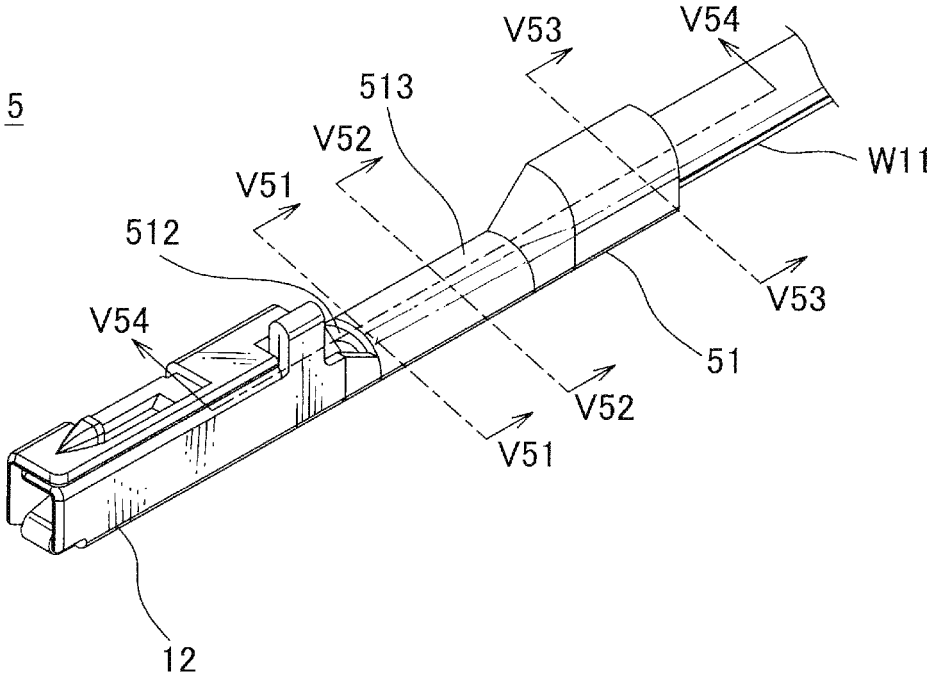
FIG. 33 illustrates the crimp terminal after the crimping that is also shown in FIG. 32.
Figure 34:
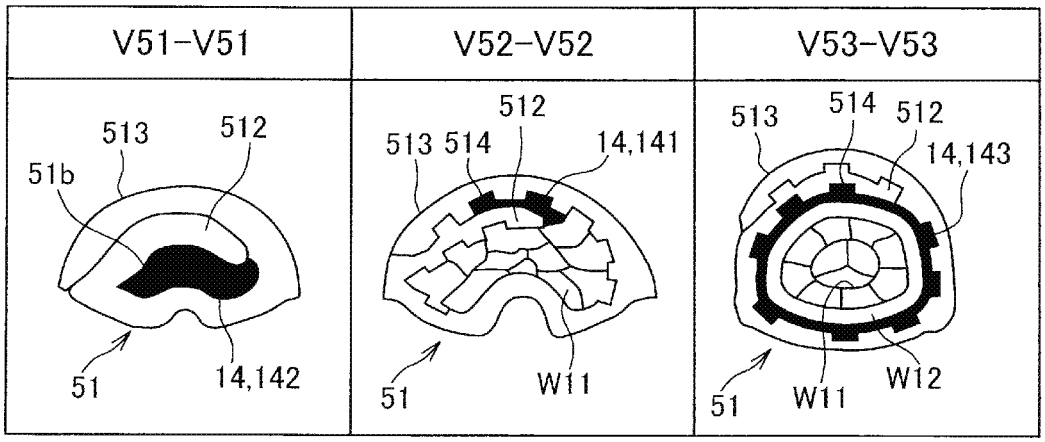
FIG. 34 shows a cross-sectional view taken along line V51-V51, a cross-sectional view taken along line V52-V52, and a cross-sectional view taken along line V53-V53 in FIG. 33.
Figure 35:
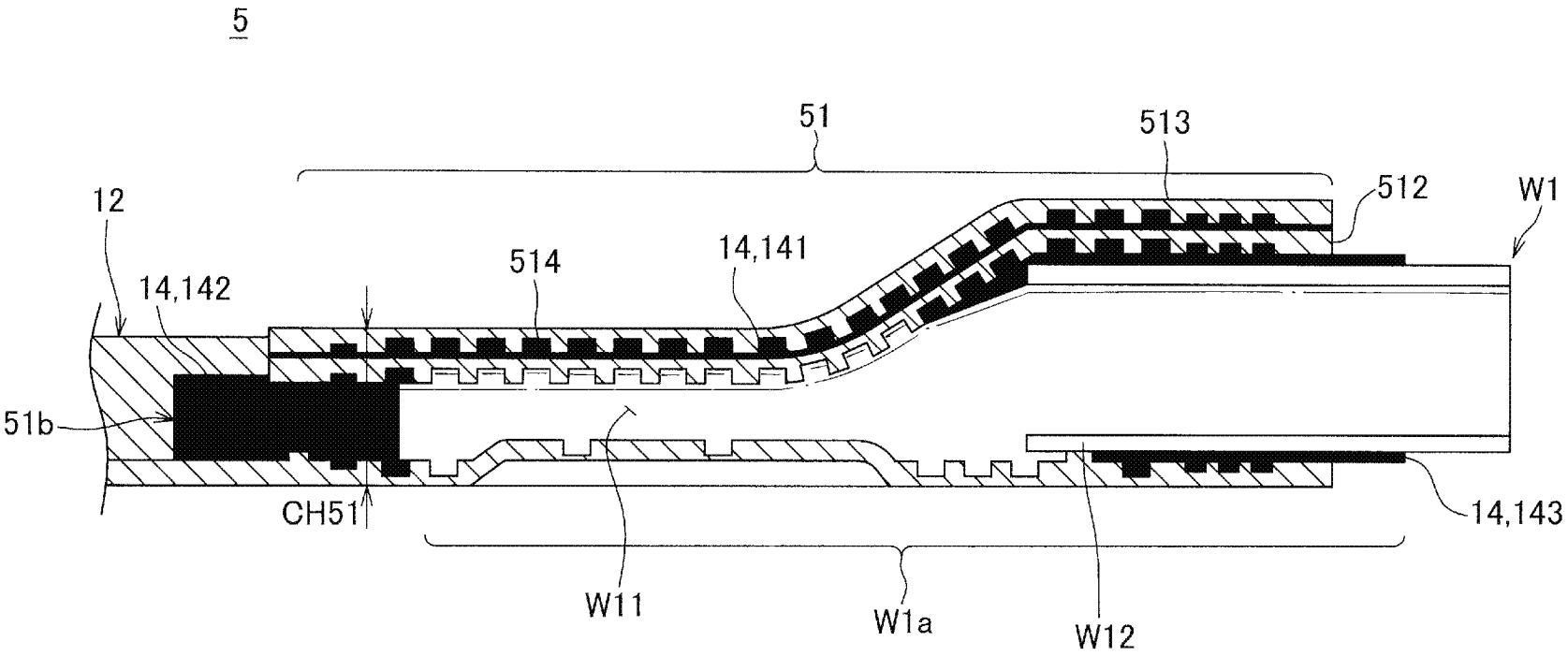
FIG. 35 is a cross-sectional view taken along line V54-V54 in FIG. 33.

FIG. 33 illustrates the crimp terminal after the crimping that is also shown in FIG. 32. FIG. 34 shows a cross-sectional view taken along line V51-V51, a cross-sectional view taken along line V52-V52, and a cross-sectional view taken along line V53-V53 in FIG. 33. Further, FIG. 35 is a cross-sectional view taken along line V54-V54 in FIG. 33.

In this embodiment, the recess 514 to be overlapped with the seal member 14 assumes a role as the groove 116 of the first embodiment. In the crimping, the movement of the seal member 14 due to the pressure applied during the crimping is inhibited by the recess 514 overlapped with the seal member 14. During the crimping, the gaps G11 formed between the second seal portion 142 and the first seal portion 141 and between the third seal portion 143 and the first seal portion 141 are closed by the elongation of the second seal portion 142 and the third seal portion 143 in the intersecting direction D11. After the crimping, a space between the inner barrel piece 512 and the outer barrel piece 513 is sealed by the first seal portion 141 of the seal member 14. Further, an opening 51*b* of the tubular barrel portion 51 on the terminal portion 12 side is sealed by the second seal portion 142, and a space between the covered portion W12 and the barrel portion 51 is sealed by the third seal portion 143.

A crimp height CH51 at the barrel portion 51 after crimped is set such that the tubular barrel portion 51 is crushed to an extent that a part of the seal member 14 projects from the opening 51*b* of the barrel portion 51. As such, the opening 51*b* of the barrel portion 51 will be sealed at a high level. Furthermore, also at the side of the barrel portion 51 at which the covered electric wire W1 is extending out, a part of the seal member 14 projects out from between the covered portion W12 and the barrel portion 51, thereby sealing this portion at a high level. In other words, the dimension such as a width of each of the first seal portion 141, the second seal portion 142 and the third seal portion 143 constituting the seal member 14 is set to a dimension necessary and sufficient to achieve the above-described sealing after the crimping. With the opening 51*b* of the barrel portion 51 and the projection of the seal member 14 on the opposite side, it is possible to visually check the sealing at these portions.

In the crimp terminal 5 of the second embodiment described above, the crimping causes edges of the respective recesses 514 provided on the inner surface 51*a* of the barrel portion 51 to bite into the aluminum core wire W11, thereby providing good electrical continuity between the covered electric wire W1 and the crimp terminal 5. Furthermore, a part of the plurality of recesses 514 provided on the inner surface of the barrel portion 51 overlaps with the seal member 14 for ensuring waterproof property with respect to the contact portion with the aluminum core wire W11. Thus, the recess 514 at a location to be overlapped with the seal member 14 can be used as a mark when providing the seal member 14 to the inner surface 51*a* of the barrel portion 51, thereby reducing difficulty of manufacturing. Further, the recesses 514 overlapped with the seal member 14 inhibit the movement of the seal member 14 due to the pressure applied during the crimping, thereby contributing to ensure waterproof property at a higher level. Thus, according to the crimp terminal 5 of this embodiment, difficulty of manufacturing can be reduced by utilizing a part of the recesses 514 provided to obtain good electrical continuity between the covered electric wire W1 and the crimp terminal 5, while ensuring waterproof property with respect to the contact portion with the aluminum core wire W11.

Furthermore, according to the crimp terminal 5 of this embodiment, the shape of the inner surface of the barrel portion 51 is formed simple with the plurality of recesses 514 dispersedly provided over substantially the entire region, thereby further reducing difficulty of manufacturing regarding forming of the barrel portion 51. Further, when providing the seal member 14, the seal member 14 can be provided approximately along the outer periphery of the barrel portion 51, and by which the seal member 14 can overlap with the recesses 514 even if the seal member 14 is arranged obliquely and such. That is, when providing the seal member 14, positional accuracy does not need to be so high, and thus in this respect also, difficulty of manufacturing can be further reduced.

Next, as modified examples of the crimp terminal 5 of the second embodiment, modified examples regarding way of attachment and shape of the seal member 14 to be attached to the barrel portion 51 will be described.

Figure 36:
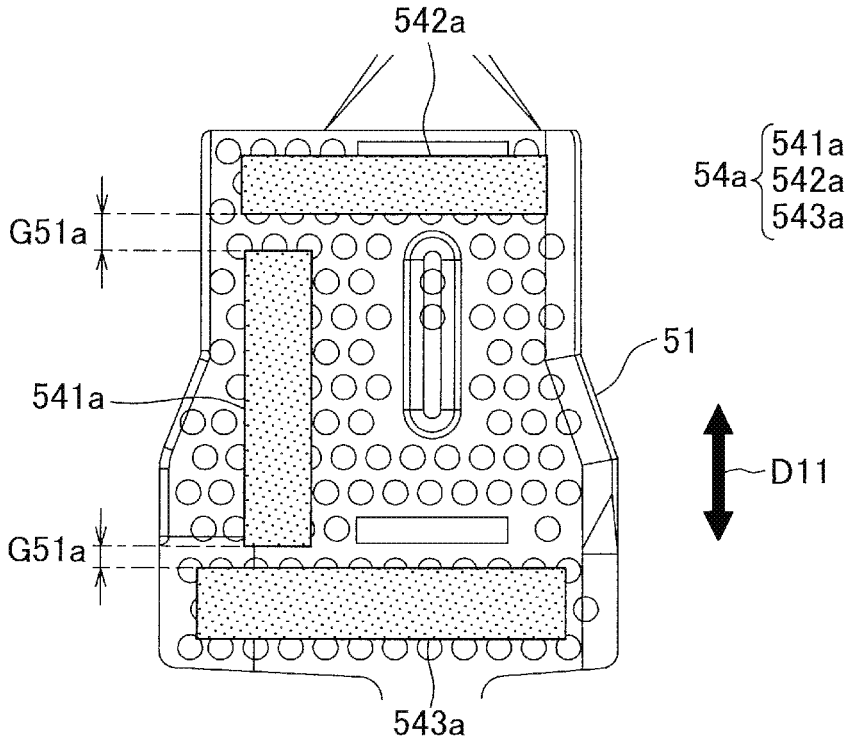
FIG. 36 shows a seal member of a first modified example with respect to the crimp terminal of the second embodiment shown in FIGS. 29-35.
Figure 37:
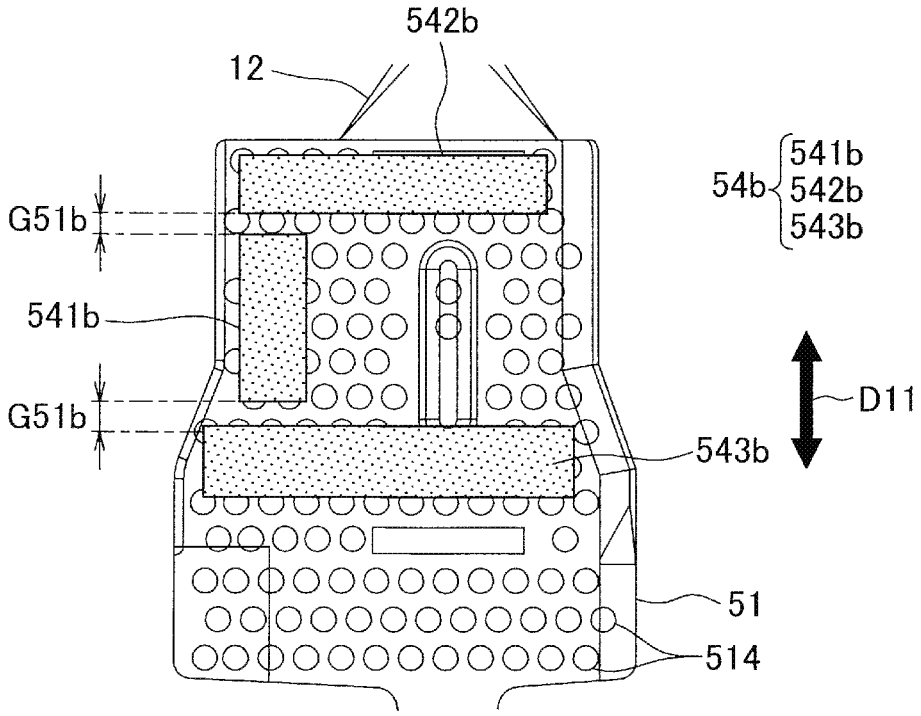
FIG. 37 shows a seal member of a second modified example with respect to the crimp terminal of the second embodiment shown in FIGS. 29-35.
Figure 38:
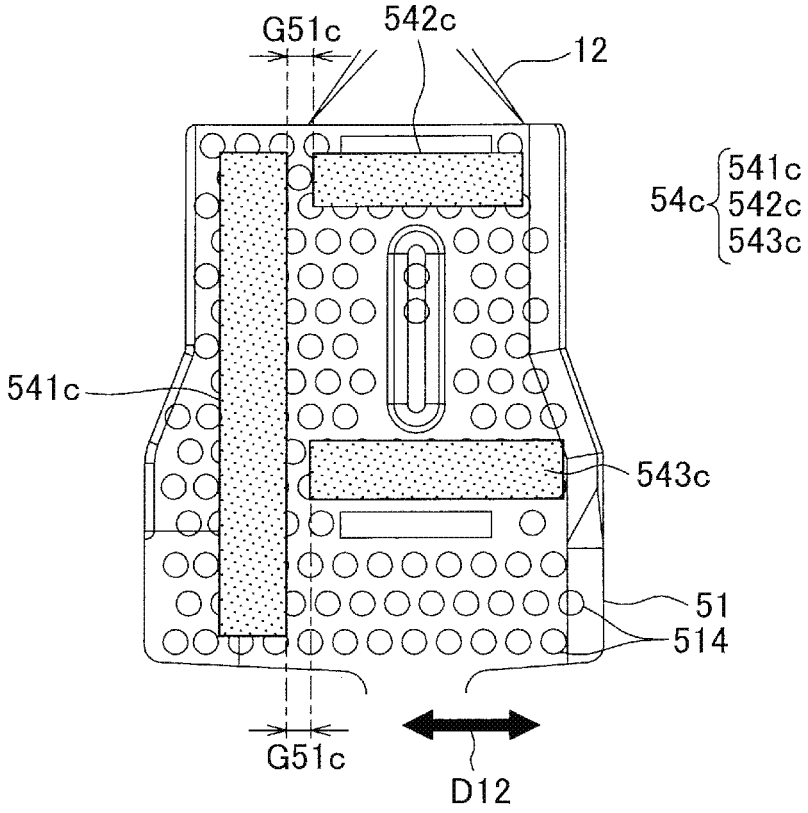
FIG. 38 shows a seal member of a third modified example with respect to the crimp terminal of the second embodiment shown in FIGS. 29-35.
Figure 39:
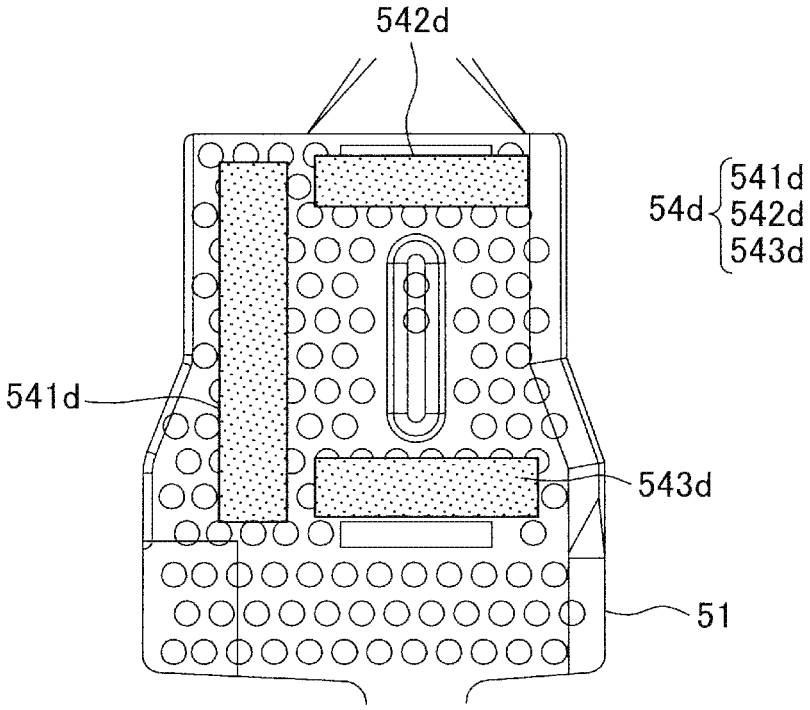
FIG. 39 shows a seal member of a fourth modified example with respect to the crimp terminal of the second embodiment shown in FIGS. 29-35.
Figure 40:
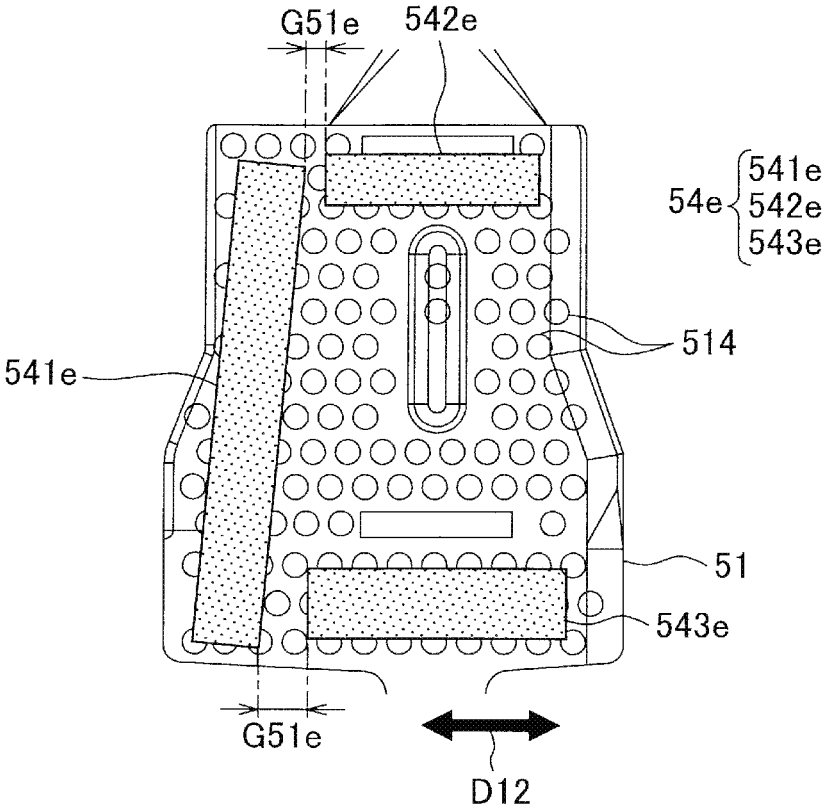
FIG. 40 shows a seal member of a fifth modified example with respect to the crimp terminal of the second embodiment shown in FIGS. 29-35.
Figure 41:
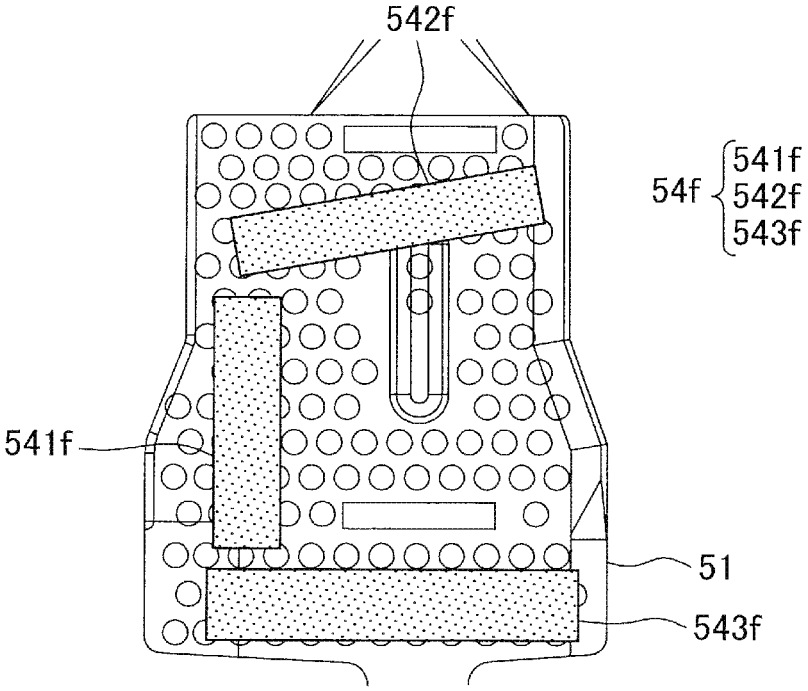
FIG. 41 shows a seal member of a sixth modified example with respect to the crimp terminal of the second embodiment shown in FIGS. 29-35.
Figure 42:
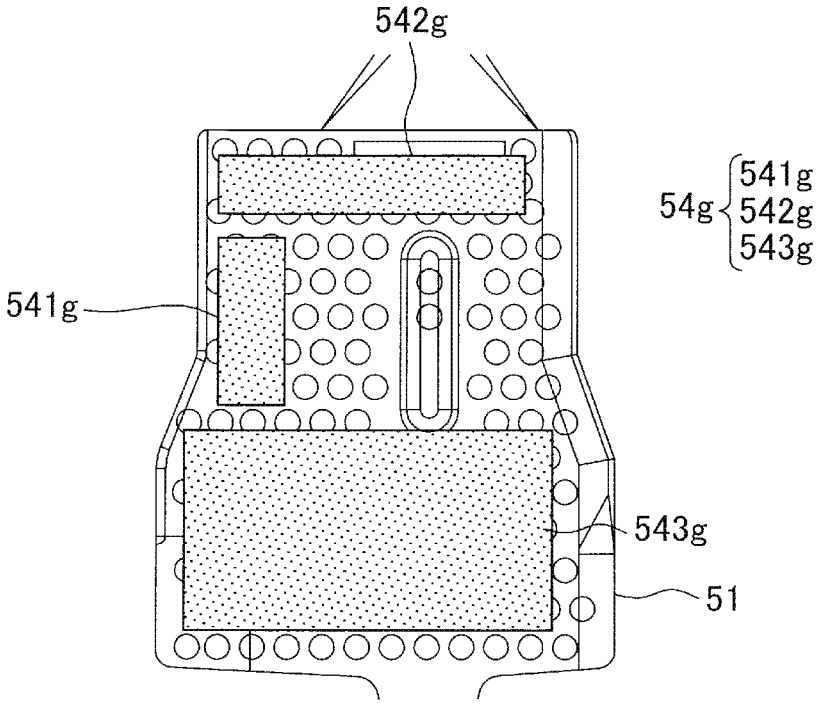
FIG. 42 shows a seal member of a seventh modified example with respect to the crimp terminal of the second embodiment shown in FIGS. 29-35.

FIG. 36 shows a seal member of a first modified example with respect to the crimp terminal of the second embodiment shown in FIGS. 29-35. FIG. 37 shows a seal member of a second modified example with respect to the crimp terminal of the second embodiment shown in FIGS. 29-35. FIG. 38 shows a seal member of a third modified example with respect to the crimp terminal of the second embodiment shown in FIGS. 29-35. FIG. 39 shows a seal member of a fourth modified example with respect to the crimp terminal of the second embodiment shown in FIGS. 29-35. FIG. 40 shows a seal member of a fifth modified example with respect to the crimp terminal of the second embodiment shown in FIGS. 29-35. FIG. 41 shows a seal member of a sixth modified example with respect to the crimp terminal of the second embodiment shown in FIGS. 29-35. FIG. 42 shows a seal member of a seventh modified example with respect to the crimp terminal of the second embodiment shown in FIGS. 29-35.

In a seal member 54*a* of the first modified example shown in FIG. 36, gaps G51*a* in the axial direction D11 are formed between a second seal portion 542*a* and a first seal portion 541*a,* and between a third seal portion 543*a* and the first seal portion 541*a*. In this first modified example, the first seal portion 541*a* is elongated in the axial direction D11 during the crimping and closes the gaps G51*a,* thereby ensuring waterproof property at a high level.

In a seal member 54*b* of the second modified example shown in FIG. 37, a first seal portion 541*b* is formed short, and entire of the seal member 54*b* is attached at a location biased closer to the terminal portion 12 compared to the first modified example. In the second modified example also, gaps G51*b* in the axial direction D11 are formed between a second seal portion 542*b* and a first seal portion 541*b,* and between a third seal portion 543*b* and the first seal portion 541*b,* and the gaps G51*b* are closed by the elongation during the crimping. In this second modified example, a region sealed by the seal member 54*b* is made narrower, but it is premised on that the attachment location of the seal member 54*b* is set to a location at which waterproof property with respect to the contact portion between the aluminum core wire W11 and the barrel portion 51 is obtained. In this second modified example, the attachment location of the seal member 54*b* is then set based on high degree of freedom of the attachment location provided with the recesses 514 formed on substantially the entire surface of the barrel portion 51. According to this second modified example, amount of the adhesive gel sheet used can be reduced by shortening the first seal portion 541*b,* thereby reducing cost.

In a seal member 54*c* of the third modified example shown in FIG. 38, gaps G51*c* in the intersecting direction D12 are formed between a second seal portion 542*c* and a first seal portion 541*c,* and between a third seal portion 543*c* and the first seal portion 541*c*. During the crimping, the second seal portion 542*c* and the third seal portion 543*c* are elongated in the intersecting direction D12 during the crimping and close the gaps G51*c*. Further, in this third modified example, the attachment location of the third seal portion 543*c* is set to a location biased closer to the terminal portion 12, based on high degree of freedom of the attachment location provided with the recesses 514 formed on substantially the entire surface of the barrel portion 51.

A seal member 54*d* according to the fourth modified example shown in FIG. 39 is a modified version of the above-described third modified example, in which a first seal portion 541*d* is made shorter, and a second seal portion 542*d* and a third seal portion 542*d* have substantially the same length.

In a seal member 54*e* of the fifth modified example shown in FIG. 40, gaps G51*e* in the intersecting direction D12 are formed between a second seal portion 542*e* and a first seal portion 541*e,* and between a third seal portion 543*e* and the first seal portion 541*e*. During the crimping, the second seal portion 542*e* and the third seal portion 543*e* are elongated in the intersecting direction D12 during the crimping and close the gaps G51*e*. Further, in this fifth modified example, the first seal portion 541*e* is attached obliquely based on high degree of freedom of the attachment location provided with the recesses 514 formed on substantially the entire surface of the barrel portion 51.

A seal member 54*f* according to the sixth modified example shown in FIG. 41 is a modified version of the above-described first modified example shown in FIG. 36, in which a first seal portion 542*f* is made shorter. Further, in this sixth modified example, a second seal portion 541*f* is attached obliquely based on high degree of freedom of the attachment location provided with the recesses 514 formed on substantially the entire surface of the barrel portion 51. A third seal portion 543*f* is equivalent to that of the first modified example of FIG. 36.

A seal member 54*g* according to the seventh modified example shown in FIG. 42 is also a modified version of the first modified example shown in FIG. 36. In this seventh modified example, a first seal portion 541*g* is made short, and a second seal portion 542*g* is made long. Further, a third seal portion 543*g* is formed long and wide.

As explained above with reference to various modified examples, the crimp terminal 5 of the second embodiment includes the recesses 514 that are formed on substantially the entire surface of the barrel portion 51. Consequently, regarding the seal member, it is possible to appropriately set way of attachment and shape thereof with high degree of freedom.

Next, further modified examples with respect to the crimp terminal 5 of the second embodiment will be described.

Figure 43:
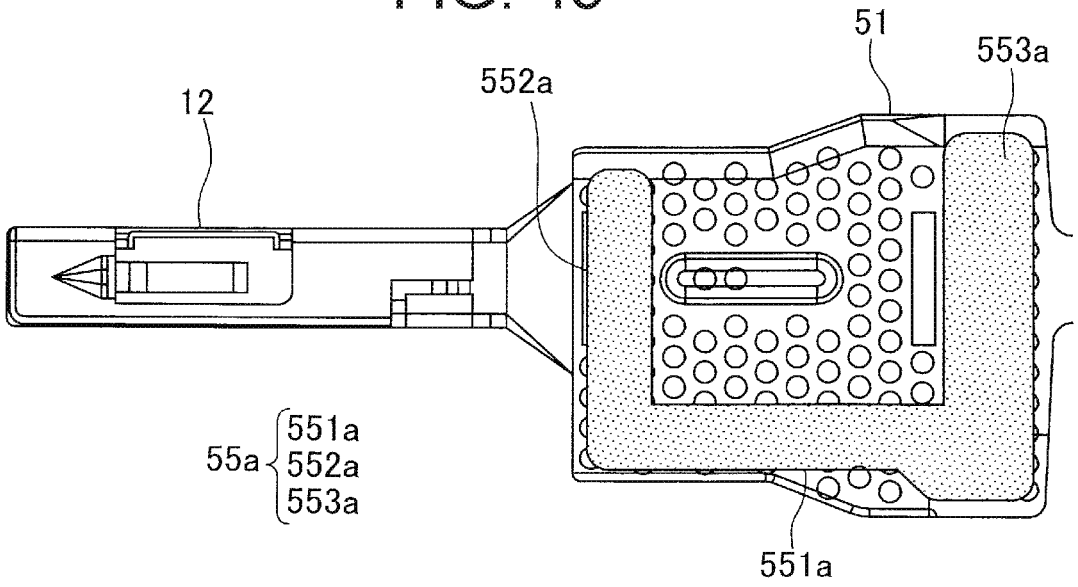
FIG. 43 shows a seal member of an eighth modified example with respect to the crimp terminal of the second embodiment shown in FIGS. 29-35.
Figure 44:
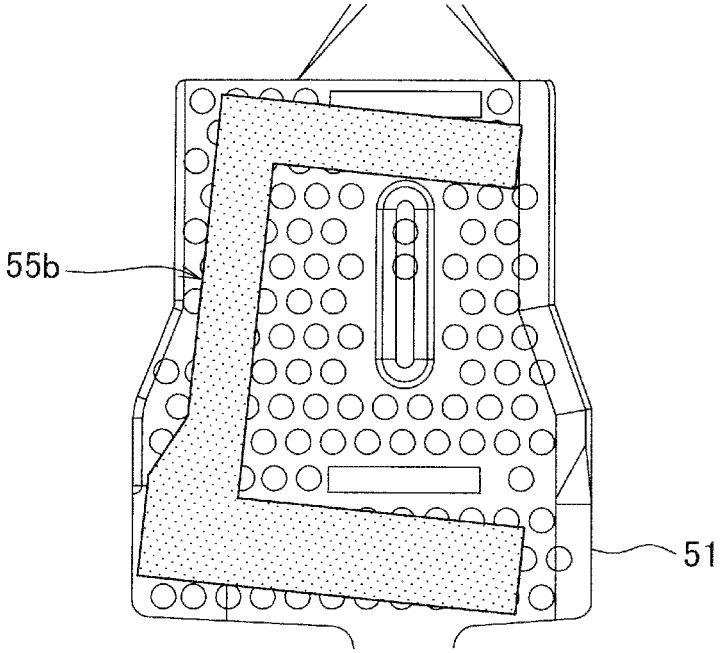
FIG. 44 shows a seal member of a ninth modified example with respect to the crimp terminal of the second embodiment shown in FIGS. 29-35.
Figure 45:
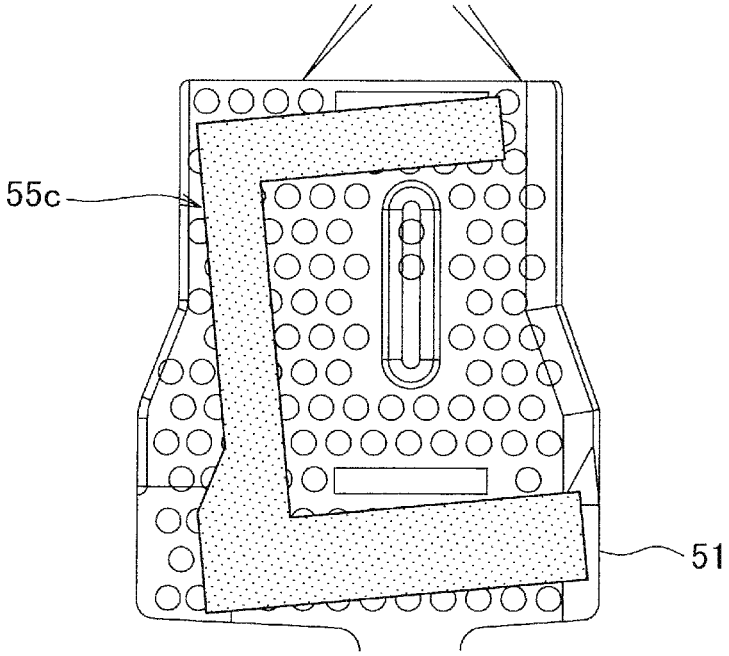
FIG. 45 shows a seal member of a tenth modified example with respect to the crimp terminal of the second embodiment shown in FIGS. 29-35.
Figure 46:
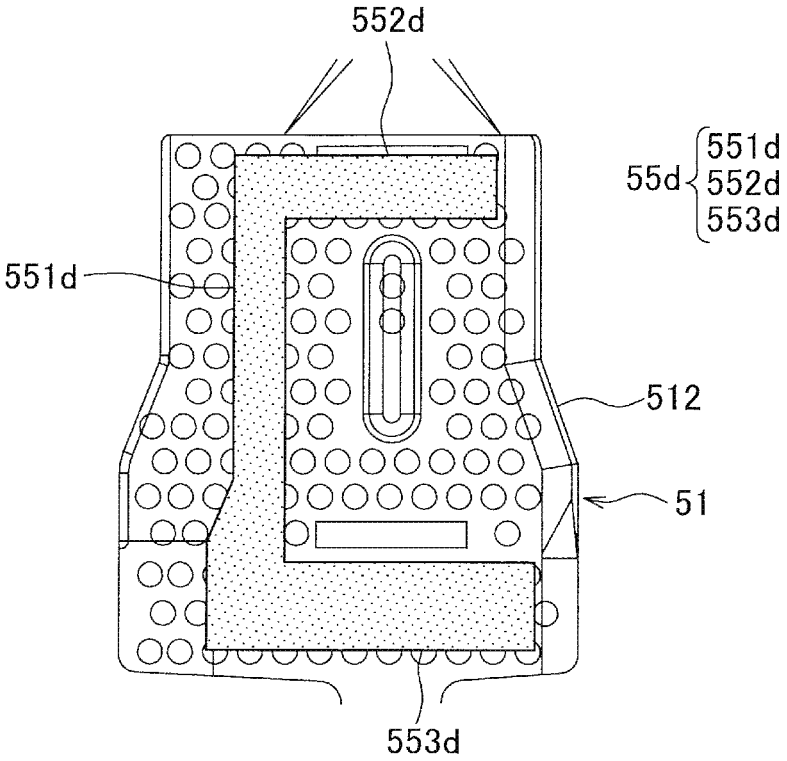
FIG. 46 shows a seal member of an eleventh modified example with respect to the crimp terminal of the second embodiment shown in FIGS. 29-35.
Figure 47:
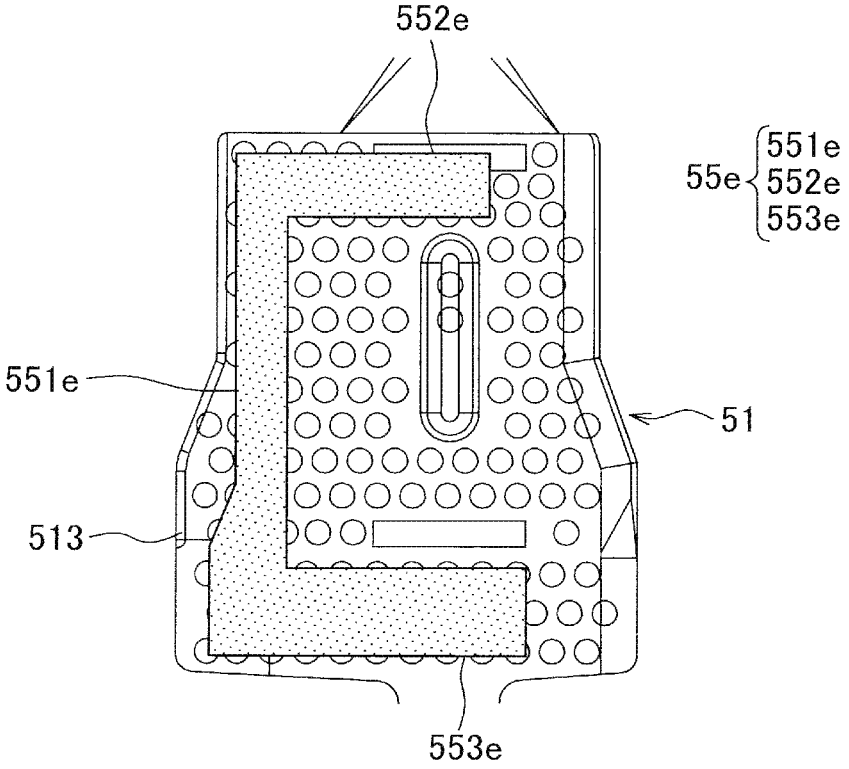
FIG. 47 shows a seal member of a twelfth modified example with respect to the crimp terminal of the second embodiment shown in FIGS. 29-35.
Figure 48:
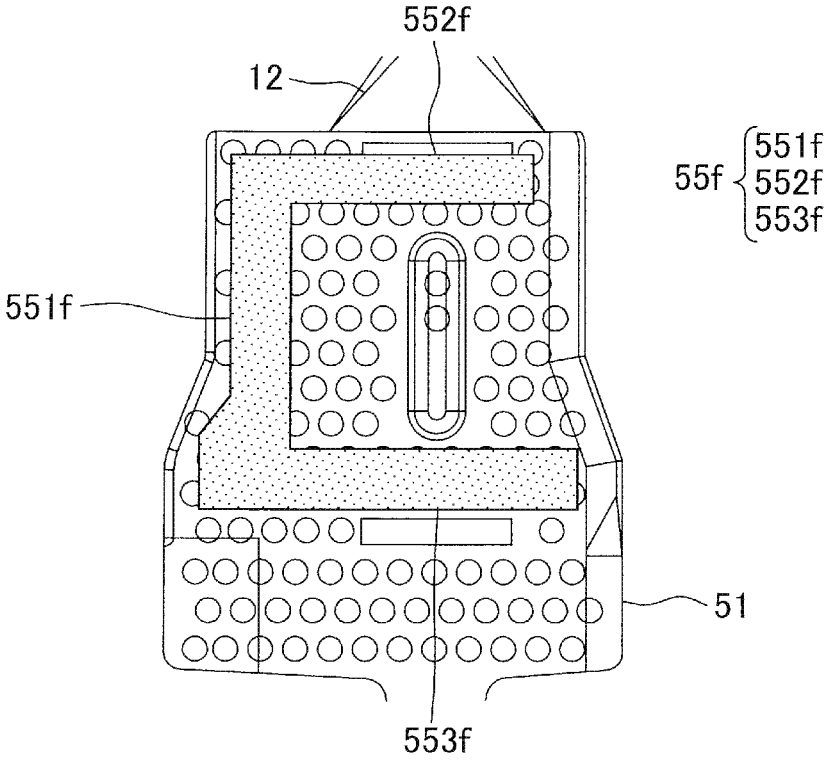
FIG. 48 shows a seal member of a thirteenth modified example with respect to the crimp terminal of the second embodiment shown in FIGS. 29-35.

FIG. 43 shows a seal member of an eighth modified example with respect to the crimp terminal of the second embodiment shown in FIGS. 29-35. FIG. 44 shows a seal member of a ninth modified example with respect to the crimp terminal of the second embodiment shown in FIGS. 29-35. FIG. 45 shows a seal member of a tenth modified example with respect to the crimp terminal of the second embodiment shown in FIGS. 29-35. FIG. 46 shows a seal member of an eleventh modified example with respect to the crimp terminal of the second embodiment shown in FIGS. 29-35. FIG. 47 shows a seal member of a twelfth modified example with respect to the crimp terminal of the second embodiment shown in FIGS. 29-35. FIG. 48 shows a seal member of a thirteenth modified example with respect to the crimp terminal of the second embodiment shown in FIGS. 29-35.

A seal member 55*a* of the eighth modified example shown in FIG. 43 is not divided, and is formed into a C-like shape in a plan view with a second seal portion 552*a* and a third seal portion 553*a* extending from and integrally connected with a first seal portion 551*a* in a two arms fashion.

Each of the modified examples shown in FIGS. 44 to 47 described below is a modified version of the eighth modified example described above.

A seal member 55*b* of the ninth modified example shown in FIG. 44 is formed into a C-like shape in a plan view with the seal member 55*b* attached to the barrel portion 51 in a manner oblique in a clockwise fashion in FIG. 44.

A seal member 55*c* of the tenth modified example shown in FIG. 45 is formed into a C-like shape in a plan view with the seal member 55*c* attached to the barrel portion 51 in a manner oblique in a counterclockwise fashion in FIG. 45.

A seal member 55*d* of the eleventh modified example shown in FIG. 46 includes a second seal portion 552*d* formed short and a third seal portion 553*d* which are connected to each other by a first seal portion 551*d*. In this eleventh modified example, the entire seal member 55*d* is attached in a state biased closer to the inner barrel piece 512 of the barrel portion 51.

A seal member 55*e* of the twelfth modified example shown in FIG. 47 also includes a second seal portion 552*e* formed short and a third seal portion 553*e* which are connected to each other by a first seal portion 551*e*. However, in this twelfth modified example, the entire seal member 55*e* is attached in a state biased closer to the outer barrel piece 513 of the barrel portion 51.

A seal member 55*f* of the thirteenth modified example shown in FIG. 48 includes a first seal portion 551*f* formed short and connecting a second seal portion 552*f* and a third seal portion 553*f* to each other. In this thirteenth modified example, the entire seal member 55*f* is attached in a state biased closer to the terminal portion 12 of the barrel portion 51.

As explained above with reference to various modified examples, in the crimp terminal 5 of the second embodiment, even when the integrally-formed seal member is used, it is possible to appropriately set way of attachment and shape of the seal member with high degree of freedom, with the recesses 514 formed on substantially the entire surface of the barrel portion 51.

The embodiments described herein only illustrate representative embodiments of the present invention, and the present invention is not limited to these embodiments. That is, various modifications may be made without departing from the scope of the present invention. One with such modifications is within the scope of the present invention as long as configuration of the present invention is included.

For example, the above-described embodiments and various modified examples exemplary show the barrel portion provided with the protrusion formed by applying pressing from the outer surface side. However, the barrel portion is not limited to this, and this protrusion may be omitted. However, as described above, by providing the protrusion, the strands of the aluminum core wire can be separated and spread thereby the number of strands contacting the barrel portion can be increased.

Furthermore, the above-described embodiments and various modified examples exemplary show the crimp terminal provided with the terminal portion 12 as a quadrangular tube-like female terminal, as one example of the terminal portion. However, the terminal portion is not limited to this, and may have other shapes and may involve other connection forms.

LIST OF REFERENCE SIGNS

1, 5 crimp terminal
11, 51 barrel portion
11*a*, 51*a* inner surface
11*a*-1, 51*a*-1 first region
11*a*-2, 51*a*-2 second region
11*a*-3, 51*a*-3 third region
11*a*-4, 51*a*-4 path
12 terminal portion
14 seal member
111, 511 bottom plate
112, 512 inner barrel piece
113, 513 outer barrel piece
114, 514 recess
115, 515 protrusion
116 groove
141 first seal portion
142 second seal portion
143 third seal portion
D11 axial direction
D12 intersecting direction
G11 gap
W1 covered electric wire
W1*a* end portion
W11 aluminum core wire
W12 covered portion

The invention claimed is:

1. A crimp terminal comprising:

a barrel portion configured to be wound around and crimped to an end portion of a covered electric wire having an aluminum core wire at which the aluminum core wire is exposed; and a terminal portion configured to be connected to a connection object, wherein the barrel portion and the terminal portion are arranged in a predetermined axial direction, wherein the barrel portion includes:

a bottom plate which extends in the axial direction and on which the end portion of the covered electric wire is to be placed; and an inner barrel piece and an outer barrel piece which extend from the bottom plate on both sides in an intersecting direction intersecting with the axial direction in a plan view with respect to the bottom plate, wherein the barrel portion is configured to be wound around the end portion, during crimping, with the inner barrel piece arranged inside, wherein the crimp terminal comprises a seal member formed from adhesive gel and configured to be provided over a first region, a second region and a third region, the first region traversing the outer barrel piece in the axial direction, the second region traversing an inner surface of the barrel portion in the intersecting direction at a location closer to the terminal portion than the aluminum core wire, and the third region traversing the inner surface in the intersecting direction so as to intersect with a covered portion of the end portion, wherein the seal member is configured to seal, after the crimping, a space between the inner barrel piece and the outer barrel piece, an opening of the barrel portion formed tubular located on a side of the terminal portion, and a space between the covered portion and the barrel portion, wherein the inner surface of the barrel portion is provided with a plurality of recesses arranged dispersedly, the recess having a circular shape or an oval shape in a plan view with respect to the inner surface, wherein a protrusion is formed on the bottom place of the barrel portion at a location where the aluminum core wire of the end portion of the covered electric wire is placed, and wherein a part of the plurality of recesses is also formed on the protrusion.

2. The crimp terminal according to claim 1, wherein a groove is formed on the inner surface of the barrel portion in the first region, the second region and the third region so as to overlap with the seal member formed from adhesive gel, and wherein the plurality of recesses is provided so as to avoid the groove.

3. The crimp terminal according to claim 1, wherein the seal member formed from adhesive gel includes a first seal portion extending in a strip-like shape in the axial direction in the first region, a second seal portion extending in a strip-like shape in the intersecting direction in the second region and a third seal portion extending in a strip-like shape in the intersecting direction in the third region, and wherein gaps are formed between the second seal portion and the first seal portion and between the third seal portion and the first seal portion.

* * * * *